US005574530A

United States Patent [19]

Sanada

[11] Patent Number: 5,574,530

[45] Date of Patent: Nov. 12, 1996

[54] DEVICE FOR APPLYING SOLVENT FOR FORMING AN IMAGE

[75] Inventor: Kazuo Sanada, Kanagawa, Japan

[73] Assignee: Fuji Photo Film Co., Ltd., Kanagawa, Japan

[21] Appl. No.: 483,275

[22] Filed: Jun. 7, 1995

[30] Foreign Application Priority Data

Oct. 19, 1994 [JP] Japan ..... 6-253987
Oct. 19, 1994 [JP] Japan ..... 6-254001
Oct. 19, 1994 [JP] Japan ..... 6-254002

[51] Int. Cl.[6] ..... G03D 17/00; G03D 3/02

[52] U.S. Cl. ..... 396/604; 347/68; 347/12; 347/85; 396/626; 396/627

[58] Field of Search ..... 354/317, 324–326; 355/247, 248, 256, 257; 118/659, 660, 662; 346/140.1, 74.2, 74.5, 141; 427/424; 347/12, 27, 28, 29, 47, 68, 74, 85

[56] References Cited

U.S. PATENT DOCUMENTS 4,081,577 3/1978 Horner ..... 354/325 X
4,115,789 9/1978 Fischbeck ..... 347/70
4,359,752 11/1982 Nakagawa et al. ..... 346/74.2
4,575,736 3/1986 Röschlein et al. ..... 347/68

FOREIGN PATENT DOCUMENTS 62-205352 9/1987 Japan ..... 354/317

*Primary Examiner*—D. Rutledge
*Attorney, Agent, or Firm*—Sughrue, Mion, Zinn, Macpeak & Seas

[57] ABSTRACT

A device for applying a solvent for forming an image includes: a spray tank in which a solvent for forming an image is filled; a nozzle which is disposed at the spray tank and at which a plurality of nozzle holes which spray the solvent for forming an image are arranged so as to be aligned linearly at fixed intervals along a direction intersecting a conveying direction of an image recording material; and an actuator which displaces the nozzle toward the image recording material on a conveying path. Because the plurality of nozzle holes are arranged so as to be aligned linearly at fixed intervals, there is no dispersion in positions at which droplets of the solvent for forming an image land on an application surface. Accordingly, uniformity on the application surface of the solvent for forming an image is not impeded due to such dispersion.

20 Claims, 18 Drawing Sheets

PRIOR ART

DEVICE FOR APPLYING SOLVENT FOR FORMING AN IMAGE

BACKGROUND OF THE INVENTION

1. Field of the Invention

The present invention relates to a device for applying solvent for forming an image, which appropriately applies a solvent for forming an image to an image recording material.

2. Description of the Related Art

An image recording apparatus is known in which image recording processing is effected by using two types of image recording materials, e.g., a photosensitive material and an image receiving material.

A device for applying solvent for forming an image, which applies a solvent for forming an image to a photosensitive material, is disposed in this type of image recording apparatus. Further, a heat developing transfer section is disposed in the image recording apparatus. The heat developing transfer section comprises a heat drum and an endless press-contact belt which press-contacts the outer periphery of the heat drum and rotates together with the heat drum.

An image is exposed on the photosensitive material while the photosensitive material is nipped and conveyed within the image recording apparatus. After water, which serves as a solvent for forming an image, is applied to the photosensitive material in a section for applying a solvent for forming an image, the photosensitive material is conveyed into the heat developing transfer section. The image receiving material is delivered into the heat developing transfer section in the same way as the photosensitive material.

In the heat developing transfer section, the photosensitive material to which water has been applied is superposed with the image receiving material, and the photosensitive material and the image receiving material are fit closely to and trained around the outer periphery of the heat drum in this superposed state. Both materials are nipped between the heat drum and the endless press-contact belt and are conveyed. Accordingly, the photosensitive material is heat-developed, and the heat-developed image is transferred onto the image receiving material so that a predetermined image is formed (recorded) on the image receiving material.

Liquid spraying devices have been heretofore known as devices for applying liquids such as water to a material to be coated. The conventional liquid spraying device has a liquid spray head which sprays liquid from nozzle holes, and can uniformly apply a plurality of liquid particulates to the application surface of an opposing material to be coated. Examples of the liquid spraying device include a spray-type atomizer, a piezoelectric-type fuel injector, an ink jet printer, an atomizer for humidification, and the like. Further, coating devices, felt-type coaters, dipping-type coaters and the like are also known.

When devices for applying a liquid to a material to be coated are used to apply a solvent for forming an image to an image recording material, various drawbacks arise as described below.

For example, in a spray-type atomizer, a liquid and a gas are mixed at the time of spraying. Therefore, gas is mixed in with the particulates forming the atomized mist, and there is dispersion in the particle sizes. This dispersion impedes the uniformity of the liquid which is applied to the application surface. Further, the positions at which the particulates forming the mist land on the application surface (the landing positions) cannot be finely controlled. Therefore, when a small amount of the liquid is applied, the uniformity of the liquid applied onto the application surface is impeded even more.

Because an atomizer for humidification randomly atomizes the liquid, drawbacks arise in that, in the same way as in the spray-type atomizer, there is dispersion in the particle sizes and in the landing positions of the particulates.

In a piezoelectric-type fuel injector and an ink jet printer, the nozzle holes are disposed so as to be concentrated in a narrow region. Therefore, the liquid spray head having the nozzle holes must be scanned within a two-dimensional plane, and a relatively large amount time is required for application of the liquid. Further, an ink jet printer is structured so as to turn each nozzle hole on and off independently. Therefore, a drawback arises in that integration technology is required to construct a liquid spray head having a plurality of nozzle holes, and the liquid spray head becomes expensive.

In coating devices and dipping-type coaters, the device itself contacts the application surface via the liquid. In felt-type coaters, the felt contacts the application surface via the liquid. As a result, substances on the application surface become mixed-in in the devices. Drawbacks arise in that the devices may become blocked or dirtied, and the durability of the devices is low.

Moreover, when a large area is to be coated by using a felt-type coater, the felt must be long. As a result, in order to achieve uniformity of the application, severe demands are made on the precision of the alignment of the felt with respect to the application surface.

In liquid spray devices which spray liquid onto an opposing surface by using a liquid spray head having nozzle holes, the liquid such as water or the like must be supplied to the liquid spray head. Accordingly, in order to supply the liquid to the liquid spray head, a structure in which a tank for accumulating the liquid is provided may be used. However, in a structure in which merely a tank is provided, the stability of the spray pressure conditions of the liquid spray head and the stable supply of the liquid cannot be ensured, and the liquid cannot be sprayed stably over a long period of time.

Further, when liquid such as water or the like is applied to a photosensitive material, there are cases in which the swelling characteristic of the liquid into the surface of the photosensitive material, which is the application surface, is poor, and swelling requires a large time period. In such cases, after the liquid droplets land on the application surface, adjacent liquid droplets on the application surface which have not yet penetrated the surface coalesce, which results in non-uniform coating.

For example, in a device such as a line-jet type device in which liquid droplets are scattered and land on the application surface, a situation such as that illustrated in FIGS. 21A–21F arises. Namely, when the liquid droplets L, which have landed on an application surface K in FIG. 21A, begin to penetrate into the application surface K as in FIGS. 21B and 21C, in FIG. 21D, adjacent liquid droplets L contact each other, interfere with each other due to surface tension, and coalesce. Thereafter, as shown in FIGS. 21D through 21F, this coalescing proceeds such that the liquid droplets L swell to varying degrees between the solid line and the dotted line, and as a result, the application surface K is coated non-uniformly.

SUMMARY OF THE INVENTION

In view of the aforementioned, an object of the present invention is to provide a device for applying a solvent for forming an image in which uniformity of liquid on an application surface is improved.

Another object is to provide a device for applying a solvent for forming an image in which the stability of the spray pressure conditions of a liquid which is a solvent for forming an image is ensured and the stable supply of the liquid is ensured, and in which the solvent for forming an image can be sprayed stably over a long period of time.

Still another object is to provide a device for applying a solvent for forming an image in which coalescing of liquid on an application surface can be prevented and uneven application can be mitigated.

In accordance with one aspect of the present invention, there is provided a device for applying a solvent for forming an image, including: a spray tank which is disposed so as to oppose a conveying path of an image recording material which has been image-exposed, and in which a solvent for forming an image is filled; a nozzle which is disposed at the spray tank as a portion of a wall surface of the spray tank which wall surface opposes the conveying path of the image recording material, and at which a plurality of nozzle holes which spray the solvent for forming an image are arranged so as to be aligned linearly at fixed intervals along a direction intersecting a conveying direction of the image recording material; and an actuator which displaces the nozzle toward the image recording material on the conveying path.

The following effects are achieved by this device for applying a solvent for forming an image.

The plurality of nozzle holes, which spray the solvent for forming an image accumulated in the spray tank, are disposed at the nozzle which is provided at the spray tank. The actuator displaces the nozzle toward the image recording material which is on the conveying path. Accordingly, as the nozzle is displaced, the solvent for forming an image is expelled from the respective nozzle holes and adheres to the image recording material.

Here, the plurality of nozzle holes which spray the solvent for forming an image are arranged so as to be aligned linearly at fixed intervals along a direction intersecting the conveying direction of the image recording material. Therefore, by the nozzle being displaced one time by the actuator, the solvent for forming an image can be applied to a wide range on the image recording material which is being conveyed.

Because the particle size is determined by the nozzle hole and because gas does not mix with the liquid, there is no dispersion in the particle size. Further, because the nozzle holes are aligned linearly at fixed intervals, there is no dispersion in the landing positions. As a result, the uniformity of the liquid on the application surface is not impeded.

Because the plurality of nozzle holes are arranged so as to be aligned linearly at fixed intervals along a direction which intersects the conveying direction of the image recording material, there is no need to scan the nozzle on a two-dimensional plane, and the solvent for forming an image can be applied to a large area in a short time.

Further, because the nozzle having the nozzle holes does not contact the image recording material, blockage, contamination or the like of the nozzle is not a problem. The durability of the device improves, and the alignment precision requirements are low.

Because it suffices merely to form a plurality of nozzle holes in the nozzle, integration technology is unnecessary, and manufacturing of the applying device at a low cost is made possible.

In the present invention, it is preferable that a plurality of nozzle rows, in each of which the plurality of nozzle holes are aligned linearly at fixed intervals along a direction intersecting the conveying direction of the image recording material, are arranged so as to be staggered. In such a device for applying a solvent for forming an image, a large number of liquid droplets adhere to the image recording material by a small number of displacements. Close-packing of the solvent (i.e., the filling of the surface of the image recording material with solvent droplets arranged densely thereon) and plural applications are made possible. The amount of solvent applied can be increased, and uniformity can be improved.

In accordance with another aspect of the present invention, there is provided a device for applying a solvent for forming an image, including: a head portion disposed so as to oppose a conveying path of an image recording material which has been image-exposed, and having nozzle holes which spray a solvent for forming an image; a spray tank to which the head portion is mounted, and at which an opening portion is formed, and in which the solvent for forming an image is filled; a replenishing tank which is disposed above the spray tank, and in which the solvent for forming an image is accumulated, and which is connected to the spray tank, and which supplies the solvent for forming an image to the spray tank by gravity; a first valve which opens a flow path between the spray tank and the replenishing tank when the solvent for forming an image is supplied to the spray tank; and a second valve which opens the opening portion and communicates an interior and an exterior of the spray tank when the solvent for forming an image is sprayed from the head portion.

The following effects are achieved by this type of device for applying a solvent for forming an image.

The first valve is opened, and the solvent for forming an image is supplied by gravity from the replenishing tank to the spray tank to which the head portion, which sprays the solvent for forming an image, is attached. When the solvent for forming an image is to be sprayed from the head portion, the second valve is opened so that the opening portion provided at the spray tank communicates with the outside air.

Accordingly, when the solvent for forming an image is sprayed from the nozzle holes of the head portion, the amount of the solvent for forming an image within the spray tank successively decreases. By opening the first valve periodically for example, the solvent for forming an image is supplied by gravity from the replenishing tank so that continuous spraying of the solvent for forming an image is ensured.

Further, when the solvent for forming an image is to be sprayed from the head portion, because the opening portion provided at the spray tank communicates with the outside air, penetration of the outside air into the spray tank from the nozzle holes of the head portion can be prevented, and continuous spraying at constant spray pressure conditions is made possible. Further, the first valve is closed at times other than times when the solvent for forming an image is supplied. Therefore, leaking of liquid from the nozzle holes can be prevented.

Accordingly, stability of the spray pressure conditions of the liquid which is the solvent for forming an image and stable supply of the liquid are ensured. The solvent for forming an image can be sprayed stably for a long period of time.

In the present invention, it is preferable that a pump forcibly delivers the solvent for forming an image to the spray tank from the replenishing tank. The solvent for forming an image can be supplied from the replenishing tank even more reliably by such a device for applying a solvent for forming an image. Moreover, because the solvent for forming an image can be forcibly supplied into the spray tank by the pump, additional solvent for forming an image can be supplied, and the interior of the spray tank can be washed when the solvent for forming an image is changed.

In accordance with still another aspect of the present invention, there is provided a device for applying a solvent for forming an image, including: a first head unit which is disposed so as to oppose a conveying path of an image recording material which has been image-exposed, and at which a plurality of nozzle holes which spray a solvent for forming an image are arranged so as to be aligned linearly at fixed intervals along a direction intersecting a conveying direction of the image recording material; and a second head unit which is disposed at the downstream side of the conveying path of the image recording material with respect to the first head unit, and at which a plurality of nozzle holes, which spray the solvent for forming an image between liquid droplets which were sprayed by the nozzle holes of the first head unit, are arranged so as to be aligned linearly at fixed intervals along a direction intersecting the conveying direction of the image recording material.

The following effects are achieved by this device for applying a solvent for forming an image.

A plurality of nozzle holes spraying the solvent for forming an image are arranged at the first head unit so as to be aligned linearly at fixed intervals along a direction intersecting the conveying direction of the image recording material. Further, a plurality of nozzle holes, which spray the solvent for forming an image between the liquid droplets sprayed from the nozzle holes of the first head unit, are arranged at the second head unit so as to be aligned linearly at fixed intervals along a direction intersecting the conveying direction of the image recording material.

Accordingly, after a fixed period of time has passed from the time when the solvent for forming an image is sprayed from the nozzle holes of the first head unit, liquid droplets sprayed from the nozzle holes of the second head unit, which is disposed at the image recording material conveying path downstream side of the first head unit, are applied between the liquid droplets which were sprayed from the nozzle holes of the first head unit and which adhere to the image recording material.

Accordingly, even in cases in which the swelling characteristic is poor, the spaces between the plurality of liquid droplets sprayed from the nozzle holes of the first head unit can be made large. As a result, adjacent liquid droplets from the nozzle holes of the first head unit do not contact each other and do not coalesce.

After the plurality of liquid droplets sprayed from the nozzle holes of the first head unit have penetrated into the image recording material, between these liquid droplets, liquid droplets sprayed from the nozzle holes of the second head unit are applied. Therefore, liquid droplets from the first head unit and adjacent liquid droplets from the second head unit do not coalesce, and the solvent for forming an image is not applied unevenly.

In the present invention, it is preferable that a plurality of nozzle rows, in each of which the plurality of nozzle holes are aligned linearly at fixed intervals along a direction intersecting the conveying direction of the image recording material, are disposed so as to be staggered at the respective head units. In such a device for applying a solvent for forming an image, a large number of liquid droplets adhere to the image recording material by a small number of sprays. Close-packing is possible, the amount of solvent applied can be increased, and uniformity can be improved.

BRIEF DESCRIPTION OF THE DRAWINGS

FIGS. 12A–12C are front views of a head plate of a device for applying a solvent for forming an image relating to a second embodiment of the present invention, wherein: FIG. 12A is a front view of a head plate in which two nozzle rows are staggered; FIG. 12B is a front view of a head plate in which three nozzle rows are staggered; and FIG. 12C is a front view of a head plate in which a pattern, in which two nozzle rows are staggered, is continuously repeated.

FIGS. 19A–19G are explanatory views for explaining penetration of water droplets applied to a photosensitive material in the case of the spray tank relating to the fourth embodiment of the present invention, wherein:

FIG. 19A illustrates a state in which the water droplets have landed on the photosensitive material;

FIG. 19B illustrates a state in which the water droplets begin to penetrate into the photosensitive material;

FIG. 19C illustrates a state in which the water droplets have penetrated further than in FIG. 19B;

FIG. 19D illustrates a state in which a new water droplet lands between the water droplets;

FIG. 19E illustrates a state in which the water droplets begin to swell;

FIG. 19F illustrates a state in which the water droplets have penetrated further than in FIG. 19E; and FIG. 19G illustrates a state in which the water droplets have penetrated further than in FIG. 19F.

FIGS. 21A–21F are explanatory views explaining penetration of liquid droplets adhering to a photosensitive material in accordance with the prior art, wherein:

FIG. 21A illustrates a state in which the liquid droplets have landed on the application surface;

FIG. 21B illustrates a state in which the liquid droplets begin to penetrate into the application surface;

FIG. 21C illustrates a state in which the liquid droplets penetrate further than in FIG. 21B;

FIG. 21D illustrates a state in which adjacent liquid droplets contact each other;

FIG. 21E illustrates a state in which the liquid droplets begin to swell; and FIG. 21F illustrates a state in which swelling is completed.

DESCRIPTION OF THE PREFERRED EMBODIMENTS

Figure 1:
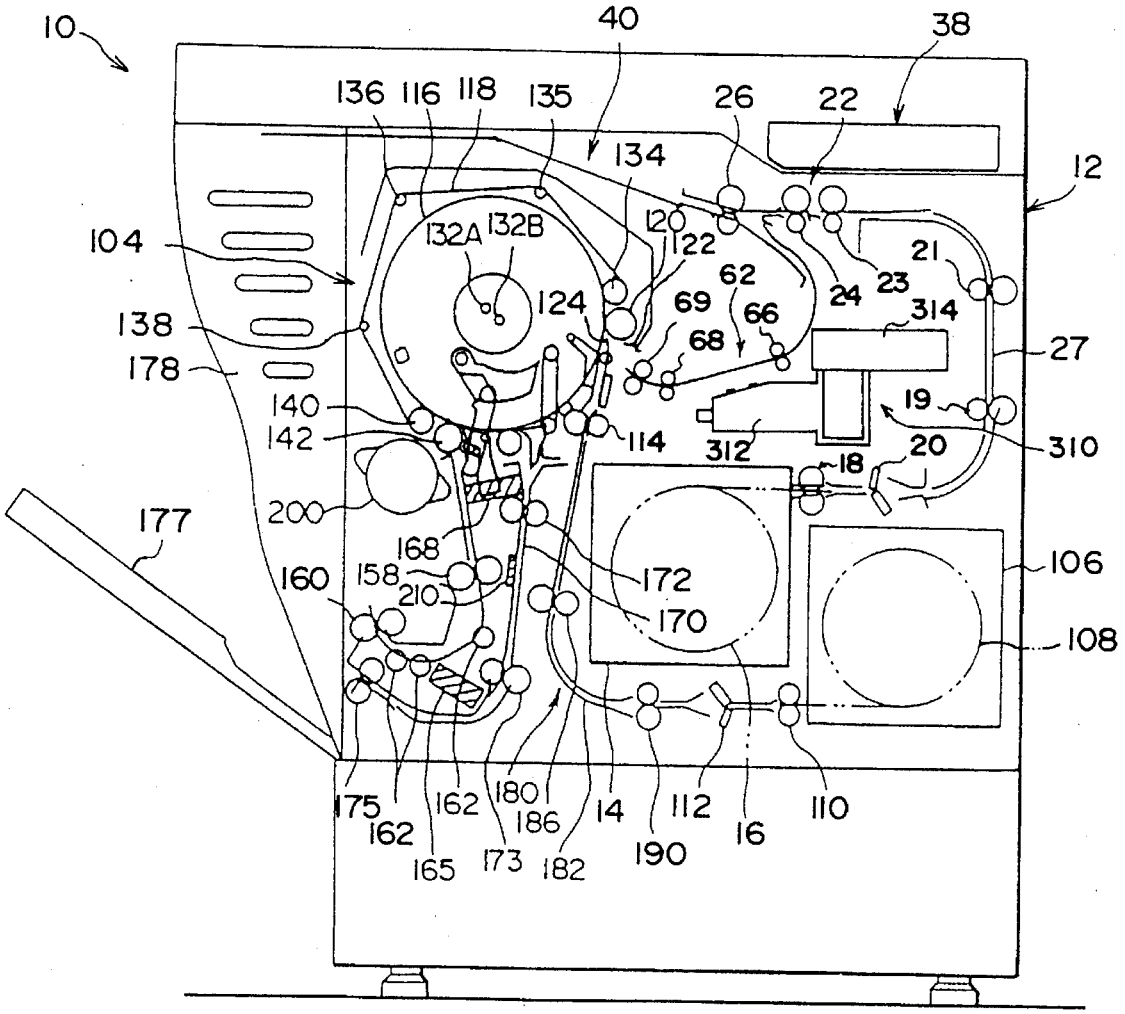
FIG. 1 is a schematic structural view of the entire structure of an image recording apparatus relating to a first embodiment of the present invention.
Figure 2:
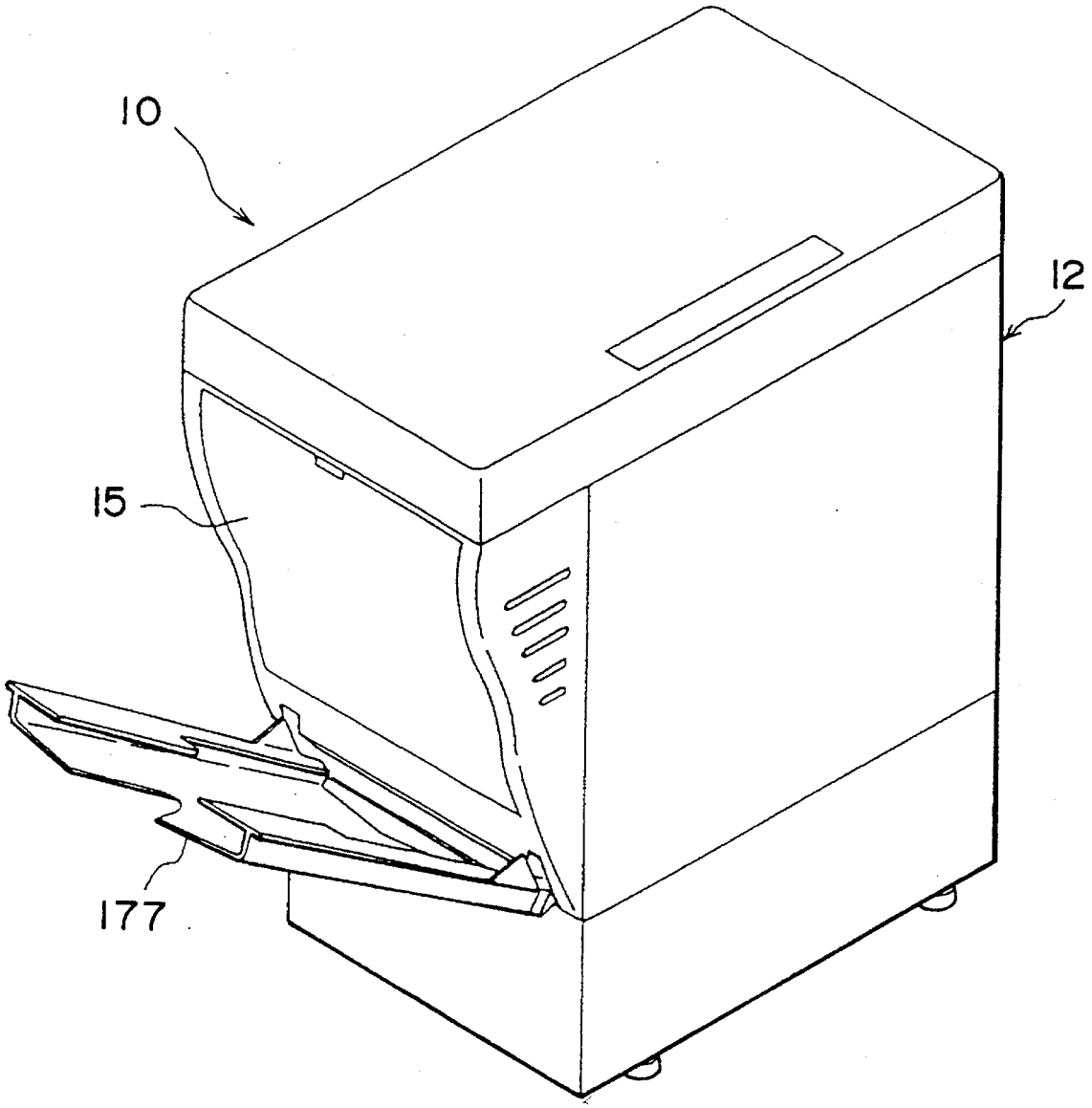
FIG. 2 is an external view of the image recording apparatus relating to the first embodiment of the present invention.

FIG. 1 is a schematic structural view of the overall structure of an image recording apparatus 10 relating to a first embodiment of the present invention. FIG. 2 is an external view of the image recording apparatus 10.

A photosensitive material magazine 14 is disposed within a machine stand 12 of the image recording apparatus 10 illustrated in these figures. A photosensitive material 16, whose transverse direction dimension is for example 224 mm, is wound in a roll-form and accommodated within the photosensitive material magazine 14. The photosensitive material 16 has a photosensitive silver halide, a binder, a dye-providing material, and a reducing agent on a supporting body. The photosensitive material 16 is wound so that the photosensitive surface (exposure surface) thereof is oriented toward the bottom of the device when the photosensitive material 16 is at the opening of the photosensitive material magazine 14 from which the photosensitive material 16 is withdrawn.

Nip rollers 18 and a cutter 20 are disposed in a vicinity of the opening of the photosensitive material magazine 14 from which the photosensitive material 16 is withdrawn so that the photosensitive material 16 can be out after a predetermined length thereof is pulled out from the photosensitive material magazine 14. The cutter 20 is, for example, a rotary-type cutter comprising a fixed blade and a moving blade. The moving blade is moved up and down by a rotating cam or the like so as to mesh with the fixed blade and cut the photosensitive material 16. After the cutter 20 is operated, the nip rollers 18 are rotated reversely and the photosensitive material 16 is rewound slightly so that the leading end portion thereof is nipped by the nip rollers 18.

A plurality of conveying rollers 19, 21, 23, 24, 26 and guide plates 27 are disposed next to the cutter 20 and convey the photosensitive material 16, which has been cut to the predetermined length, to an exposure section 22.

The exposure section 22 is positioned between the upstream side pair of conveying rollers 23 and the downstream side pair of conveying rollers 24. The exposure section 22 has an exposure point between the conveying rollers 23, 24, and the photosensitive material 16 passes through the exposure point while being nipped by the conveying rollers 23, 24. The conveying speed at which the photosensitive material 16 is conveyed by the conveying rollers 23, 24 (i.e., the speed at which the photosensitive material 16 passes through the exposure section 22) is, for example, 12 mm/sec.

An exposure device 38 is provided directly above the exposure section 22. Three types of laser diodes (LDs), a lens unit, a polygon mirror, and a mirror unit (all unillustrated) are disposed in the exposure device 38.

A switch back section 40 is provided next to the exposure section 22. An applying device 310, which applies a solvent for forming an image, is provided beneath the exposure section 22. In the present embodiment, water is used as the solvent for forming an image. The photosensitive material 16, which was conveyed upwardly at the side of the photosensitive material magazine 14 and which was exposed at the exposure section 22, is delivered temporarily into the switch back section 40. Thereafter, the conveying rollers 26 are rotated reversely so that the photosensitive material 16 is delivered into a water applying section 62 of the applying device 310 via a conveying path provided under the exposure section 22.

Figure 3:
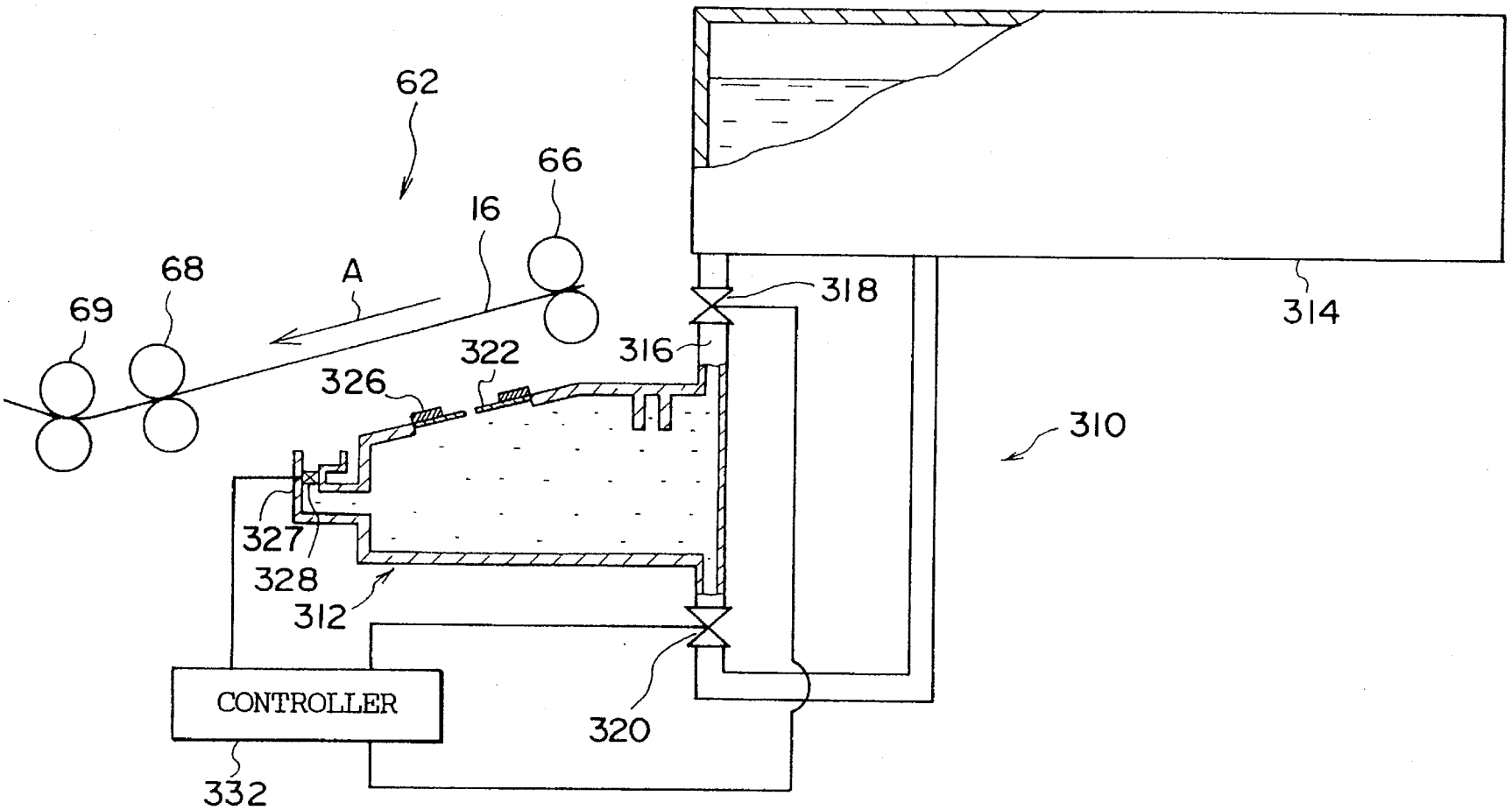
FIG. 3 is a schematic structural view of the entire structure of a device for applying a solvent for forming an image relating to the first embodiment of the present invention.

As illustrated in FIG. 3, a spray tank 312 is disposed at a position opposing a conveying path A of the photosensitive material 16 in the water applying section 62. A pair of conveying rollers 66 are disposed at the photosensitive material 16 conveying direction upstream side of the spray tank 312. Two pairs of conveying rollers 68, 69 are disposed at the photosensitive material 16 conveying direction downstream side of the spray tank 312.

A pool tank 314, which is a replenishing tank in which water which is the solvent for forming an image is accumulated, is disposed above the spray tank 312. A pipe 316 is connected in a loop-shape to the bottom side of the pool tank 314. The spray tank 312 is disposed on the route of the pipe 316.

An upper valve 318 which is a first valve and a lower valve 320 are disposed at positions of the pipe 316 above and below the spray tank 312, respectively. The flow path within the pipe 316 can be opened and closed by the pair of valves 318, 320. Water flowing due to gravity from the pool tank 314 is filled into the spray tank 312 via the pipe 316.

Figure 4:
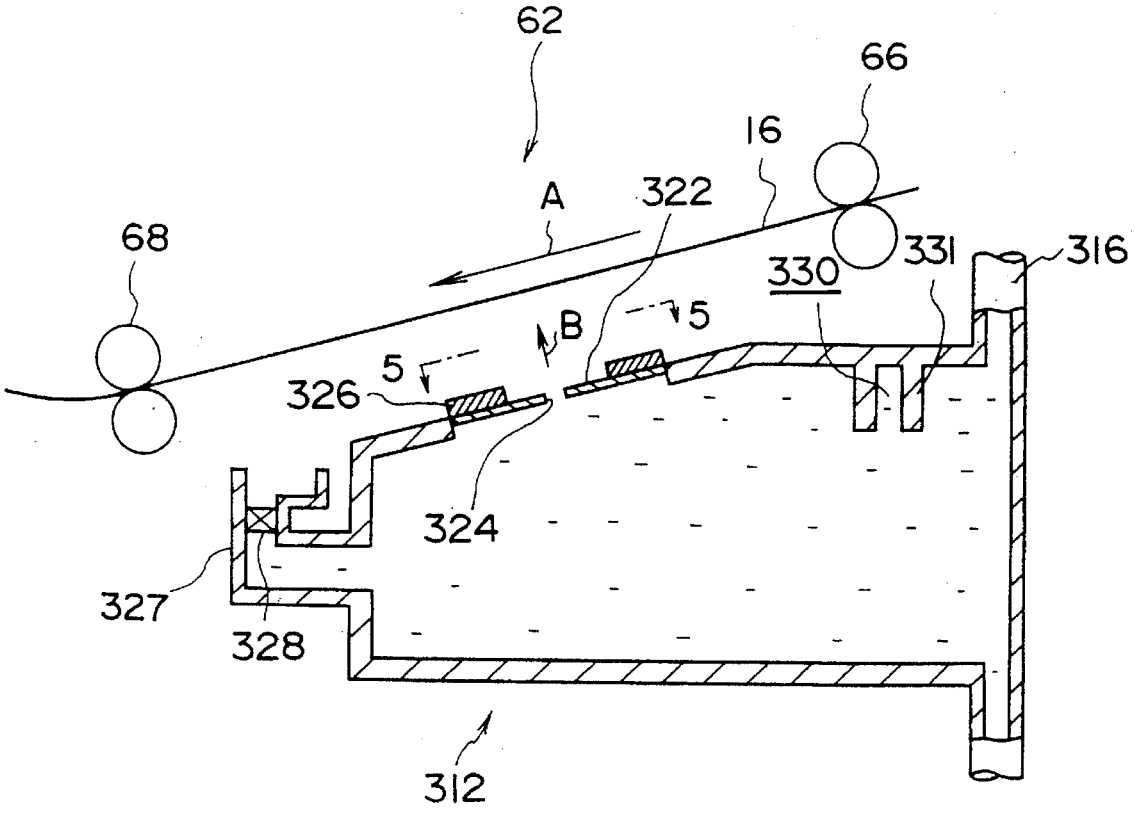
FIG. 4 is an enlarged partial sectional view of a spray tank relating to the first embodiment of the present invention.

As illustrated in FIG. 4 which is an enlarged view of the spray tank 312, a head plate 322 is disposed at a portion of the wall surface of the spray tank 312 which wall surface opposes the conveying path A of the photosensitive material 16. The head plate 322 is a nozzle which is formed as an elastically deformable thin plate.

Figure 5:
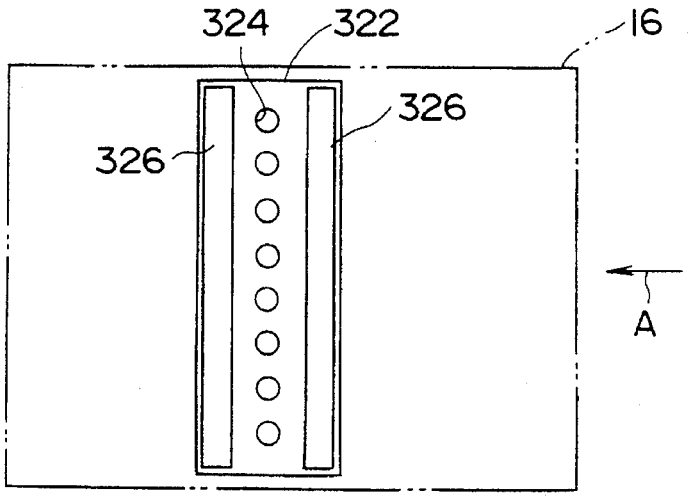
FIG. 5 is a view taken along arrow 5—5 of FIG. 4.

As illustrated in FIG. 5, a plurality of nozzle holes 324 (respectively having a diameter of, for example, several tens of μm) for spraying the water filled in the spray tank 312 are arranged at the head plate 322 so as to be aligned linearly at fixed intervals along a direction intersecting the conveying direction A of the photosensitive material 16. Therefore, water within the spray tank 312 can be discharged from the respective nozzle holes 324.

Monomorphic or bimorphic (i.e., single-layer or double-layer) piezoelectric elements 326 which are an actuator are adhered on the head plate 322. An unillustrated power source is connected to the piezoelectric elements 326. A head portion is formed by the head plate 322 and the piezoelectric elements 326.

Figure 6:
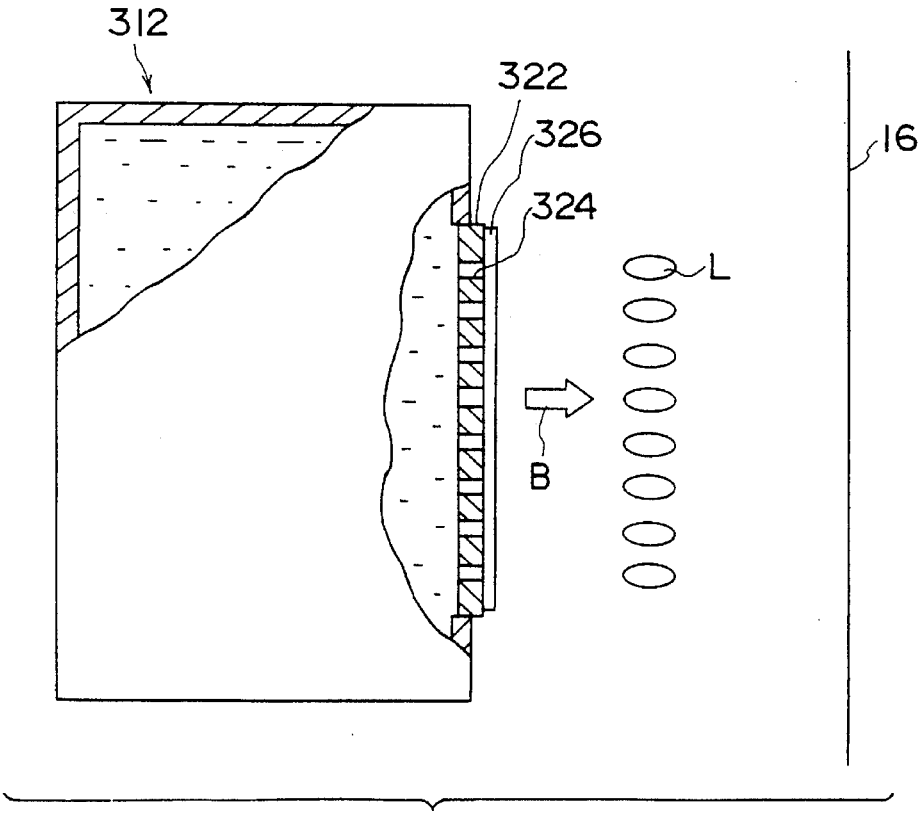
FIG. 6 is an explanatory view concisely illustrating the spray tank relating to the first embodiment of the present invention.

Accordingly, when electric power is supplied to the piezoelectric elements 326 from the power source, the piezoelectric elements 326 bend the head plate 322 so that the central portion of the head plate 322 is displaced toward the photosensitive material 16 on the conveying path A (i.e., so that the central portion is displaced along the direction of arrow B which is a direction normal to the head plate 322). As the head plate 322 is displaced toward the photosensitive material 16, water droplets L are expelled from the plurality of nozzle holes 324 as shown in FIG. 6, which concisely illustrates the spray tank 312.

As illustrated in FIG. 4, at a position slightly lower than the nozzle holes 324 of the spray tank 312, an opening portion 327, which communicates the interior and exterior of the spray tank 312, is formed and a tank valve 328, which is a second valve and which opens and closes the opening portion 327, is provided. By the opening/closing operation of the tank valve 328, the interior of the spray tank 312 can be communicated with or closed off from the outside air. As illustrated in FIG. 3, the upper valve 318, the lower valve 320 and the tank valve 328 are connected to a controller 332. The opening/closing of the respective valves 318, 320, 328 is controlled by the controller 332.

An air resting portion 330, whose periphery is enclosed by a tubular rib 331, is formed at the inner wall surface of the upper portion of the spray tank 312. In accordance with variations in pressure within the spray tank 312 at the time that water is sprayed from the nozzle holes 324, water having low inertia can be supplied rapidly from the periphery of the air resting portion 330 to a vicinity of the nozzle holes 324, and can be discharged to the air resting portion 330 from a vicinity of the nozzle holes 324.

As shown in FIG. 1, a receiving material magazine 106 is disposed next to the photosensitive material magazine 14 in the machine stand 12. An image receiving material 108 wound in roll-form is accommodated within the receiving material magazine 106. A dye fixing material having mordant is applied to the image forming surface of the image receiving material 108. The image receiving material 108 is wound such that the image forming surface thereof is oriented toward the top of the device when the image receiving material 108 is at the opening of the receiving material magazine 106 from which the image receiving material 108 is withdrawn.

Nip rollers 110 are disposed in a vicinity of the opening of the receiving material magazine 106 from which the image receiving material 108 is withdrawn. The nip rollers 110 can pull the image receiving material 108 out from the receiving material magazine 106, and the nipping thereof can be released.

A cutter 112 is disposed next to the nip rollers. In the same way as the previously-described cutter 20 for the photosensitive material, the cutter 112 is for example a rotary-type cutter comprising a fixed blade and a moving blade. The moving blade is moved up and down by a rotating cam or the like so as to mesh with the fixed blade. The image receiving material 108 which has been pulled out from the receiving material magazine 106 is thereby cut to a length which is shorter than the length of the photosensitive material 16.

The entrance end portion of an image receiving material conveying section 180, which is positioned next to the photosensitive material magazine 14, is disposed next to the cutter 112. Conveying rollers 186, 190, 114 and guide plates 182 are disposed in the image receiving material conveying section 180, and can convey the image receiving material 108, which has been cut to a predetermined length, to a heat developing transfer section 104.

Figure 7:
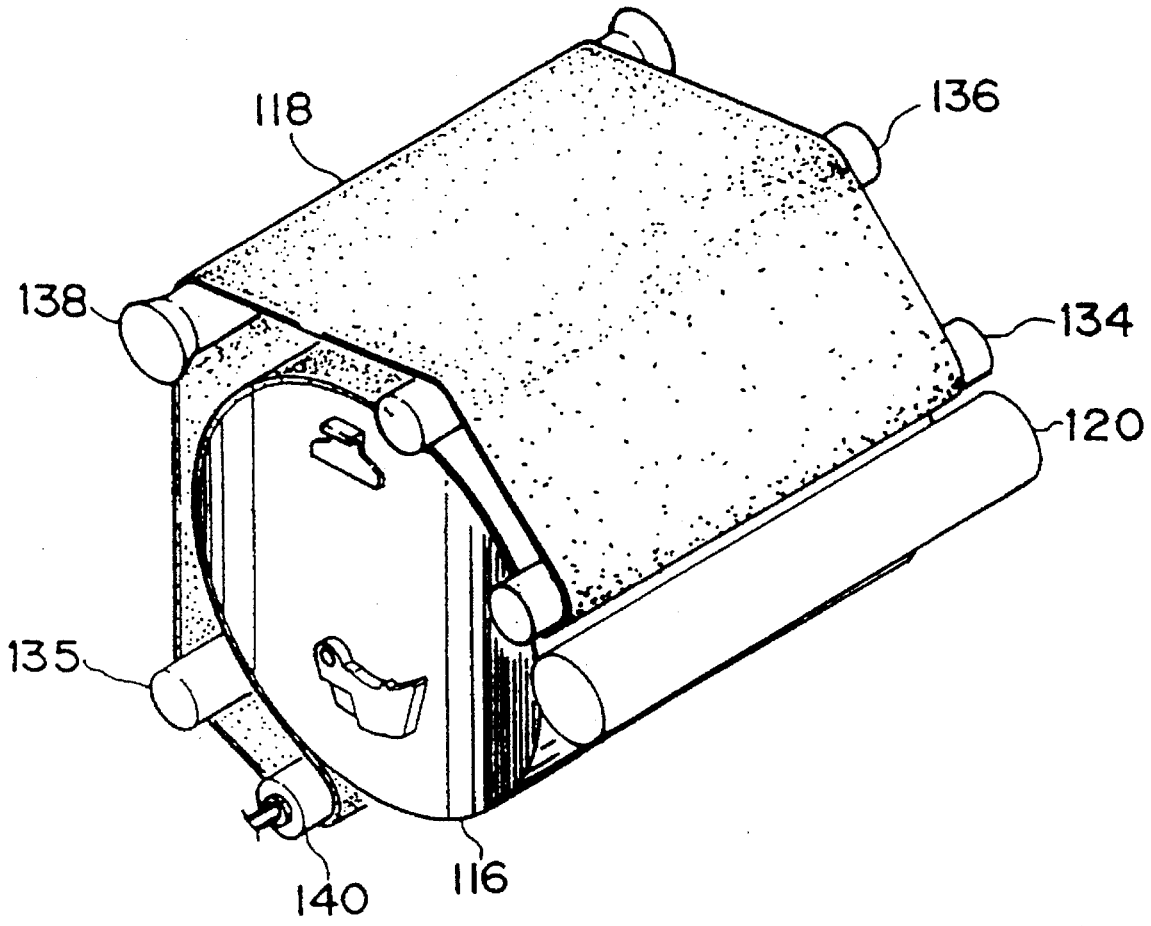
FIG. 7 is a perspective view of a heat drum of a heat developing transfer section.

As illustrated in FIG. 7, the heat developing transfer section 104 is formed by a heat drum 116 and an endless press-contact belt 118. A laminating roller 120 is disposed at the outer periphery of the heat drum 116 at the water applying section 62 side.

A guide plate 122 is disposed on the conveying path of the photosensitive material 16 between the laminating roller 120 and the conveying rollers 69 of the water applying section 62, at a position opposing the rear surface (i.e., the surface opposite the image forming surface) of the photosensitive material 16 delivered from the conveying rollers 69. The guide plate 122 guides the photosensitive material 16 to the laminating roller 120.

The laminating roller 120 is connected to a drum motor 200 via an unillustrated drive system. The drive force of the drum motor 200 is transmitted to the laminating roller 120, and the laminating roller 120 is rotated thereby.

The photosensitive material 16 conveyed to the heat developing transfer section 104 is delivered between the laminating roller 120 and the heat drum 116. Synchronously with the conveying of the photosensitive material 16, the image receiving material 108 is conveyed between the laminating roller 120 and the heat drum 116 in a state in which the photosensitive material 16 precedes the image receiving material 108 by a predetermined length (20 mm in the present embodiment), and the photosensitive material 16 and the image receiving material 108 are superposed. In this case, because both the transverse direction dimension and the longitudinal direction dimension of the image receiving material 108 are smaller than those of the photosensitive material 16, the photosensitive material 16 and the image receiving material 108 are superposed in a state in which the peripheral portions of the photosensitive material 16 at all four sides thereof protrude beyond the peripheral portions of the image receiving material 108.

A pair of halogen lamps 132A, 132B are disposed at the interior portion of the heat drum 116. The halogen lamps 132A, 132B output, for example, 400 W and 450 W respectively. The surface of the heat drum 116 can thereby be heated so that the temperature of the surface is raised to a predetermined temperature (e.g., approximately 82° C.). In this case, when raising of the temperature begins, both of the halogen lamps 132A, 132B are used, and thereafter, during normal operation, only one halogen lamp 132A is used.

The endless press-contact belt 118 is trained around five training rollers 134, 135, 136, 138, 140. The outer peripheral surface of the endless press-contact belt 118 between the training roller 134 and the training roller 140 press-contacts the outer periphery of the heat drum 116.

The training roller 140 is connected to the drum motor 200 via an unillustrated drive system. The drive force of the drum motor 200 is transmitted to the training roller 140, and the training roller 140 is rotated thereby. When the training roller 140 is rotated, the endless press-contact belt 118 trained therearound is rotated. Accordingly, the rotating force of the endless press-contact belt 118 is transmitted to the heat drum 116 due to frictional force between the endless press-contact belt 118 and the heat drum 116, so that the heat drum 116 rotates dependently.

The drum motor 200 drives a plurality of driving portions, i.e., the training roller 140, the laminating roller 120, and the conveying rollers 68, 69, as well as the following rollers which will be described later: a bending/guiding roller 142, photosensitive material discharge rollers 158, 160, and receiving material discharge rollers 172, 173, 175.

The photosensitive material 16 and the image receiving material 108, which are superposed by the laminating roller 120, are nipped in a superposed state between the heat drum 116 and the endless press-contact belt 118, and are conveyed over approximately ⅔ of the periphery of the heat drum 116 (between the training roller 134 and the training roller 140). When the superposed photosensitive material 16 and image receiving material 108 are completely held between the heat drum 116 and the endless press-contact belt 118, the rotation of the heat drum 116 is temporarily stopped (e.g., for 5 to 15 seconds), so that the nipped photosensitive material 16 and image receiving material 108 are heated. When the photosensitive material 16 is heated while being nipped and conveyed and while stopped, mobile dyes are released, and at the same time, the dyes are transferred to the dye fixing layer of the image receiving material 108 so that an image is obtained.

The bending/guiding roller 142 is disposed beneath the heat drum 116 at the material supplying direction downstream side of the endless press-contact belt 118. The bending/guiding roller 142 is a rubber roller formed of silicon rubber. Drive force from the drum motor 200 is transmitted to the bending/guiding roller 142 so that the bending/guiding roller 142 is rotated thereby. The bending/guiding roller 142 press-contacts the outer periphery of the heat drum 116 at a predetermined pressure. The photosensitive material 16 and the image receiving material 108, which were conveyed by the heat drum 116 and the endless press-contact belt 118, are nipped by the bending/guiding roller 142 and are conveyed further thereby.

A peeling claw (unillustrated) is disposed beneath the heat drum 116 at the material supplying direction downstream side of the bending/guiding roller 142. Of the photosensitive material 16 and the image receiving material 108 which are nipped between and conveyed by the endless press-contact belt 118 and the heat drum 116, the peeling claw engages only the leading end portion of the photosensitive material 16 and peels this leading end portion from the outer periphery of the heat drum 116.

The photosensitive material discharge rollers 158, 160 and a plurality of guide rollers 162 are disposed beneath the bending/guiding roller 142 and the peeling claw and further convey the photosensitive material 16, which moves downward while trained around the bending/guiding roller 142, so that the photosensitive material 16 can be accumulated in a waste photosensitive material accommodating box 178. As mentioned previously, drive force of the drum motor 200, which drives the heat developing transfer section 104, is transmitted to the photosensitive material discharge rollers 158, 160 which are rotated thereby.

A drying fan 165 is disposed in a vicinity of the guide rollers 162 and promotes the drying of the photosensitive material 16.

A receiving material guide 170 and the receiving material discharge rollers 172, 173, 175 are disposed beneath the heat drum 116 and to the right of the bending/guiding roller 142 in FIG. 1. The image receiving material 108, which has been peeled from the heat drum 116 by a peeling claw (unillustrated) different than the one mentioned above, is guided and conveyed by the receiving material guide 170 and the receiving material discharge rollers 172, 173, 175.

A drum fan 168 is disposed beneath the heat drum 116. The image receiving material 108 moving along the heat drum 116 is dried by the heat of the heat drum 116, and the drying is promoted by the drum fan 168. Further, a ceramic heater 210 is disposed at the receiving material guide 170 so that the drying of the image receiving material 108 which is being conveyed can be promoted even more.

While the drying of the image receiving material 108 is promoted by the drum fan 168, the image receiving material 108 is peeled from the outer periphery of the heat drum 116 by the peeling claw. The peeled image receiving material 108 is conveyed by the receiving material guide 170 and the receiving material discharge rollers 172, 173, 175, and is discharged to a tray 177.

Next, operation of the present embodiment will be described.

In the image recording apparatus 10 having the above-described structure, after the photosensitive material magazine 14 is set, the nip rollers 18 are operated, and the photosensitive material 16 is pulled out by the nip rollers 18. When a predetermined length of the photosensitive material 16 has been pulled out, the cutter 20 is operated so that the photosensitive material 16 is cut to a predetermined length.

After the cutter 20 is operated, the cut photosensitive material 16 is conveyed by the conveying rollers 19, 21, 23, 24, 25, is reversed, and is conveyed to the exposure section 22 with the photosensitive surface (exposure surface) thereof facing upward. At the point in time when the photosensitive material 16 is nipped by the conveying rollers 23, the driving of the conveying rollers 23 is temporarily stopped so that the photosensitive material 16 is held in a standby state immediately before the exposure section 22.

Next, driving of the conveying rollers 23, 24 is started, and the photosensitive material 16 passes through the exposure section 22 at a predetermined speed. Simultaneously with the conveying of the photosensitive material 16 (i.e., simultaneously with the photosensitive material 16 passing through the exposure section 22), the exposure device 38 is operated so that an image is scanned/exposed onto the photosensitive material 16 positioned at the exposure section 22.

When exposure has been completed, the exposed photosensitive material 16 is sent to the water applying section 62. At the water applying section 62, the conveyed photosensitive material 16 is sent toward the spray tank 312 by the driving of the conveying rollers 66, and is nipped and conveyed by the conveying rollers 68, 69.

Water is applied to the photosensitive material 16, which is being conveyed along the conveying path A, by spray from the spray tank 312. The operations at this time will be described hereinafter.

First, the upper valve 318 and the lower valve 320 are opened and the tank valve 328 is set in a closed state by the controller 332. Water is supplied from the pool tank 314 to the spray tank 312 via the pipe 316 due to gravity, so that water is filled in the spray tank 312.

When water is to be sprayed from the head plate 322, conversely, the upper valve 318 and the lower valve 320 are closed and the tank valve 328 is opened. The interior of the spray tank 312 communicates with the exterior via the opening portion 327 provided at the spray tank 312.

Accordingly, in a state in which water has been filled and the tank valve 328 has been opened, electric power from the power source is supplied so that the piezoelectric elements 326 deform, and the head plate 322 of the spray tank 312 is displaced. As the head plate 322 is displaced, water is emitted in the direction of arrow B from the respective nozzle holes 324 and adheres to the photosensitive material 16 which is being conveyed. Due to the continuous spraying of water from the nozzle holes 324, water is applied to the entire surface of the photosensitive material 16 which is being conveyed.

At this time, as illustrated in FIG. 5, the plurality of nozzle holes 324 spraying water are arranged so as to be aligned linearly at fixed intervals along a direction intersecting the conveying direction A of the photosensitive material 16. As a result, water can be applied to a wide range on the photosensitive material 16 by the head plate 322 being displaced one time due to the piezoelectric elements 326.

Because the particle size is determined by the nozzle hole 324 and because gas does not mix with the liquid, there is no dispersion in the particle size. Further, because the nozzle holes 324 are aligned linearly at fixed intervals, there is no dispersion in the landing positions. As a result, the uniformity of the liquid which lands on the surface of the photosensitive material 16 which is an application surface is not impeded by such dispersion.

Because the plurality of nozzle holes 324 are arranged so as to be aligned linearly at fixed intervals along a direction which intersects the conveying direction of the photosensitive material 16, there is no need to scan the head plate 322 on a two-dimensional plane, and water can be applied to a large area in a short time. Further, because the head plate 322 having the nozzle holes 324 does not contact the photosensitive material 16, there is no blockage, sullying or the like. The durability of the applying device 310 improves, and the alignment precision requirements are low.

Because it suffices to merely form a plurality of nozzle holes 324 in the head plate 322, integration technology is unnecessary, and manufacturing of the applying device 310 at a low cost is made possible.

When water is sprayed from the nozzle holes 324 of the head plate 322, the amount of water in the spray tank 312 successively decreases. Due to the control effected by the controller 332, periodically, the upper valve 318 and the lower valve 320 are opened and the tank valve 328 is closed. Accordingly, water is supplied by gravity from the pool tank 314, and continuous spraying of water can be ensured.

When water is sprayed from the head plate 322, the opening portion 327 which is provided below the head plate 322 of the spray tank 312 communicates with the exterior. Therefore, the pressure of the water in a vicinity of the nozzle holes 324 can be maintained constant. As a result, penetration of external air into the spray tank 312 from the nozzle holes 324 can be prevented. Continuous spray under constant spray pressure conditions and control of the amount of water for one time of spraying are made possible.

At times when water is sprayed from the nozzle holes 324 and at times when water is not supplied from the pool tank 314, the upper valve 318 and the lower valve 320 are shut and the tank valve 328 is opened by the controller 332, and a vacuum is formed within the spray tank 312 in a vicinity of the nozzle holes 324. Accordingly, leaking of liquid from the nozzle holes 324 can be prevented. Further, when water is sprayed, a large amount of water is not sprayed unnecessarily.

In accordance with the present embodiment, stability of the water spray pressure conditions and stable supply of water are ensured, and water can be sprayed stably for a long period of time.

Water can be rapidly supplied to and discharged from the periphery of the air resting portion 330 in accordance with variations in the pressure within the spray tank 312 at the time of spraying. Accordingly, even if the head plate 322 having the nozzle holes 324 is displaced rapidly, in accordance with the rapid displacement of the head plate 322, water can rapidly be sent to the periphery of the nozzle holes 324 from the air resting portion 330 and can rapidly be sent from the periphery of the nozzle holes 324 to the air resting portion 330. Penetration of outside air into the spray tank 312 is prevented by the air resting portion 330 as well.

Thereafter, the photosensitive material 16, to which water serving as a solvent for forming an image has been applied in the water applying section 62, is delivered into the heat developing transfer section 104 by the conveying rollers 68, 69.

As the scanning/exposing of the photosensitive material 16 begins, the image receiving material 108 is pulled out from the receiving material magazine 106 by the nip rollers 110 and is conveyed thereby. When a predetermined length of the image receiving material 108 has been pulled out, the cutter 112 is operated so as to cut the image receiving material 108 to a predetermined length.

After the cutter 112 is operated, the cut image receiving material 108 is conveyed by the conveying rollers 190, 186, 114 while being guided by the guide plates 182 of the image receiving material conveying section 180. When the leading end portion of the image receiving material 108 is nipped by the conveying rollers 114, the image receiving material 108 is held in a standby state immediately before the heat developing transfer section 104.

At the heat developing transfer section 104, when the delivery of the photosensitive material 16 between the outer periphery of the heat drum 116 and the laminating roller 120 by the conveying rollers 68, 69 is detected, the conveying of the image receiving material 108 is restarted so that the image receiving material 108 is delivered to the laminating roller 120, and also the heat drum 116 is operated.

Thereafter, when the photosensitive material 16 and the image receiving material 108 are nipped and conveyed and reach the bottom portion of the heat drum 116, the peeling claw is operated. The peeling claw engages the leading end portion of the photosensitive material 16 which is conveyed so as to precede the image receiving material 108 by a predetermined length. The leading end portion of the photosensitive material 16 is peeled from the outer periphery of the heat drum 116 and is trained around the bending/guiding roller 142. The photosensitive material 16 which is trained around the bending/guiding roller 142 is conveyed by the photosensitive material discharge rollers 158, 160 while being guided by the guide rollers 162. The photosensitive material 16 is dried by the drying fan 165 at this time, and is accumulated in the waste photosensitive material accommodating box 178.

The image receiving material 108 which has been separated from the photosensitive material 16 is conveyed by the receiving material discharge rollers 172, 173, 175 while being guided by the receiving material guide 170. The image receiving material 108 is discharged into the tray 177 while being dried by the drum fan 168 and the ceramic heater 210.

In a case in which image recording processing is effected a plurality of times, the above processes are carried out continuously in succession.

In this way, the image receiving material 108, which is trained around the heat drum 116 and which undergoes heat developing transfer processing so that a predetermined image is formed (recorded) thereon, is peeled from the heat drum 116. Thereafter, the drying of the image receiving material 108 is promoted by drying means such as the drum fan 168 and the ceramic heater 210, or the like. The image receiving material 108 is nipped and conveyed by the plurality of receiving material discharge rollers 172, 173, 175, and is discharged to the exterior of the device.

Modified examples of the applying device 310 of the image recording apparatus 10 relating to the first embodiment of the present invention are illustrated in FIGS. 8 through 11 and are described hereinafter.

Figure 8:
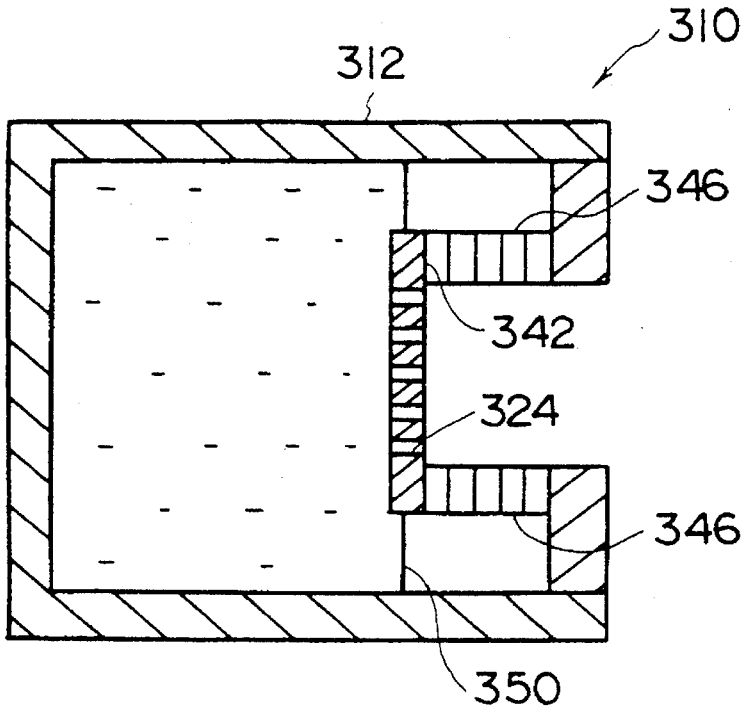
FIG. 8 is an explanatory view concisely illustrating a first modified example of the spray tank relating to the first embodiment of the present invention.

As illustrated in FIG. 8, in the applying device 310 of the first modified example, the head plate 342 which is the nozzle is formed by a plate having high rigidity. Seal members 350 for preventing water from escaping are disposed at the periphery of the head plate 342. The wall surfaces of the spray tank 312 and the head plate 342 are connected at laminated piezoelectric elements 346.

Figure 9:
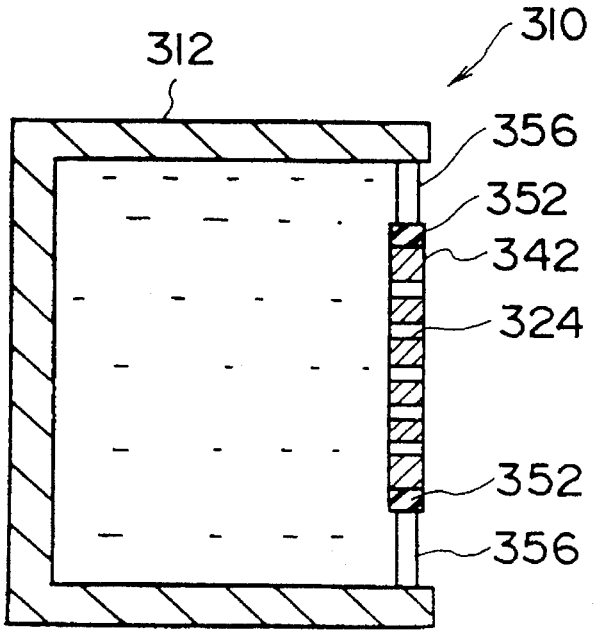
FIG. 9 is an explanatory view concisely illustrating a second modified example of the spray tank relating to the first embodiment of the present invention.

As illustrated in FIG. 9, in the applying device 310 of the second modified example, the head plate 342 which is the nozzle is formed by a plate having high rigidity. The wall surfaces of the spray tank 312 and the head plate 342 are connected at monomorphic or bimorphic piezoelectric elements 356 via buffer materials 352 such as packing or the like.

Figure 10:
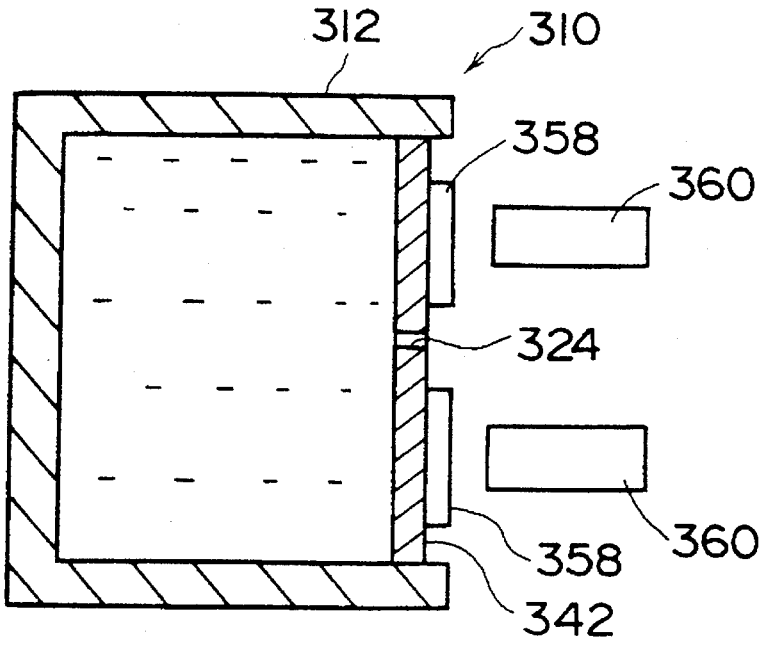
FIG. 10 is an explanatory view concisely illustrating a third modified example of the spray tank relating to the first embodiment of the present invention.

As illustrated in FIG. 10, in the applying device 310 of a third modified example, steel plates 358 which are magnetic are affixed to the head plate 342 which is the nozzle, and electromagnets 360 are disposed so as to oppose the steel plates 358. In the present modified example, instead of affixing the steel plates 358, the head plate 342 itself may be formed by a steel plate.

Due to the above-described structure, the head plate 342 can be displaced by the attraction force or repulsion force of the electromagnets 360. Note that FIG. 10 is different from the other modified examples and is a sectional view viewed from above the spray tank 312.

Figure 11:
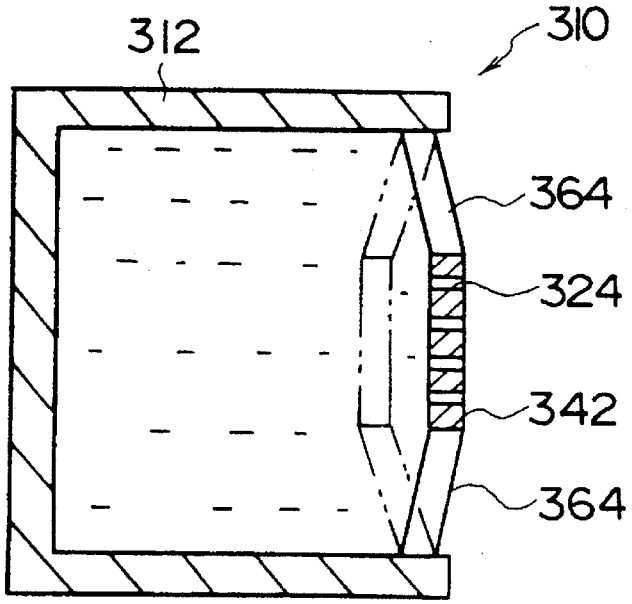
FIG. 11 is an explanatory view concisely illustrating a fourth modified example of the spray tank relating to the first embodiment of the present invention.

As illustrated in FIG. 11, in the applying device 310 of the fourth modified example, the head plate 342 which is the nozzle is formed by a plate having high rigidity. Further, the head plate 342 and the wall surfaces of the spray tank 312 are connected at movable plates 364, which have high rigidity, so as to be deformable. The connections between the head plate 342 and the movable plates 364 and the connections between the wall surfaces of the spray tank 312 and the movable plates 364 are respectively hinge-like connections. Further, unillustrated piezoelectric elements which are monomorphic, bimorphic, laminated or the like, or electromagnets 360 such as those in the third modified example are used as the actuator. The position illustrated by the solid lines in the figure and the position illustrated by the two-dot chain lines in the figure are respectively stable points, and the head plate 342 is displaced between these stable points by the actuator.

Due to the structures of the respective modified examples described above, the head plate 342 is displaced in the same way as described previously. Accordingly, water is expelled from the plurality of nozzle holes 324 in the respective modified examples, and adheres to the photosensitive material 16 in the same way as in the previously-described operation of the first embodiment.

In the first embodiment, the upper valve 318 is used as the first valve for maintaining the pressure of the liquid within the spray tank 312. However, the upper valve 318 and the lower valve 320 may serve as the first valve.

Figure 12C:
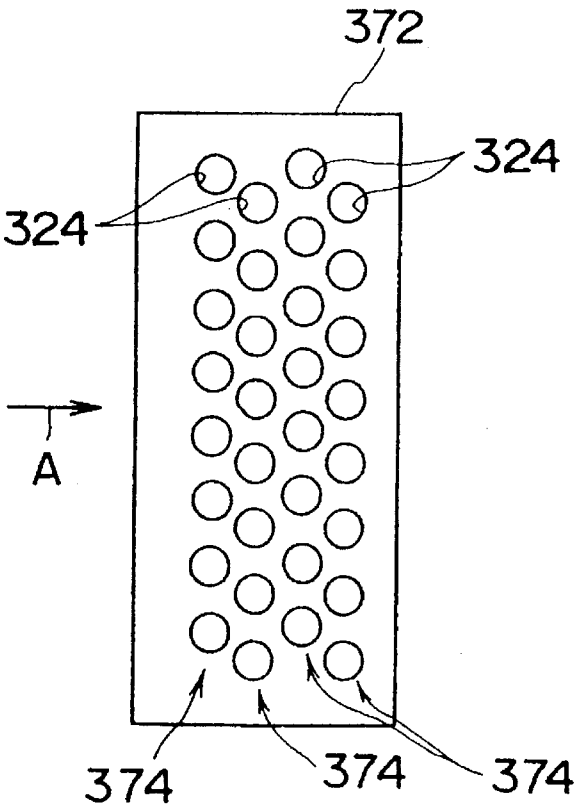
Figure 12B:
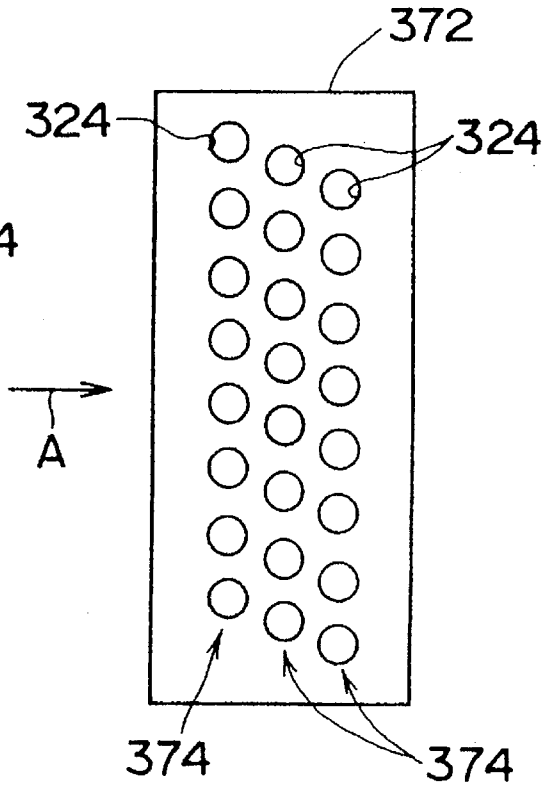
Figure 12A:
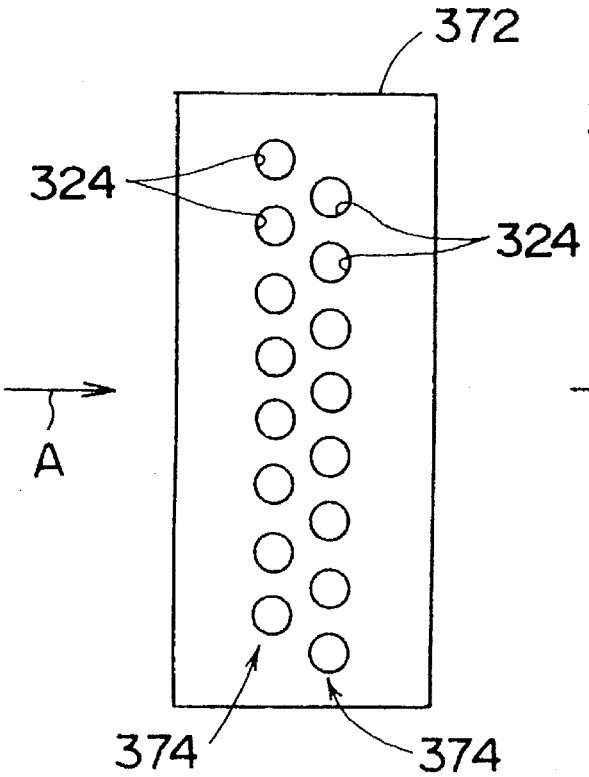

A head plate of the applying device 310 of the image recording apparatus 10 relating to the second embodiment of the present invention is illustrated in FIG. 12A and is described hereinafter. Members which are the same as those described in the first embodiment are denoted by the same reference numerals, and duplicate description thereof is omitted.

As illustrated in FIG. 12A, in a head plate 372 which is the nozzle of the applying device 310 relating to the present embodiment, two nozzle rows 374 are arranged so as to be staggered. In each nozzle row 374, the plurality of nozzle holes 324 which spray water are aligned linearly at fixed intervals along a direction intersecting the direction of the conveying path A of the photosensitive material 16. In the same way as in the first embodiment, the head plate 372 is formed by an elastically deformable thin plate. Unillustrated piezoelectric elements serving as an actuator are adhered to the head plate 372.

Next, operation of the present embodiment will be described.

The present embodiment has the same operation as the first embodiment. However, in the present embodiment, a plurality of the nozzle rows 374, in each of which the plurality of nozzle holes 324 are aligned linearly at fixed intervals along a direction intersecting the conveying direction of the photosensitive material 16, are arranged at the head plate 372 so as to be staggered. Therefore, a large number of water droplets adhere to the photosensitive material 16 by the head plate 372 being displaced a small number of times. Close-packing of water and plural applications are made possible. The amount of water applied can be increased, and uniformity can be improved.

Modified examples of the applying device 310 relating to the second embodiment of the present invention are illustrated in FIGS. 12B and 12C and are described hereinafter.

As illustrated in FIG. 12B, three nozzle rows 374, in each of which the plurality of nozzle holes 324 which spray water are aligned linearly at fixed intervals along a direction intersecting the conveying direction of the photosensitive material 16, are arranged so as to be staggered at the head plate 372 which is the nozzle of the applying device 310 relating to the first modified example.

As illustrated in FIG. 12C, a pattern in which two rows of the nozzle rows 374 are staggered is continuously repeated at the head plate 372 which is the nozzle of the applying device 310 relating to the second modified example. In each of the nozzle rows 374, the plurality of nozzle holes 324 which spray water are aligned linearly at fixed intervals along a direction intersecting the conveying direction of the photosensitive material 16.

In accordance with the structures of the first and second modified examples, by displacing the head plate 372 as described previously, water is expelled from the respective nozzle holes 324 forming the plurality of nozzle rows 374. Close-packing of water and plural applications are made possible. The amount of water applied can be increased, and uniformity can be improved.

Figure 13:
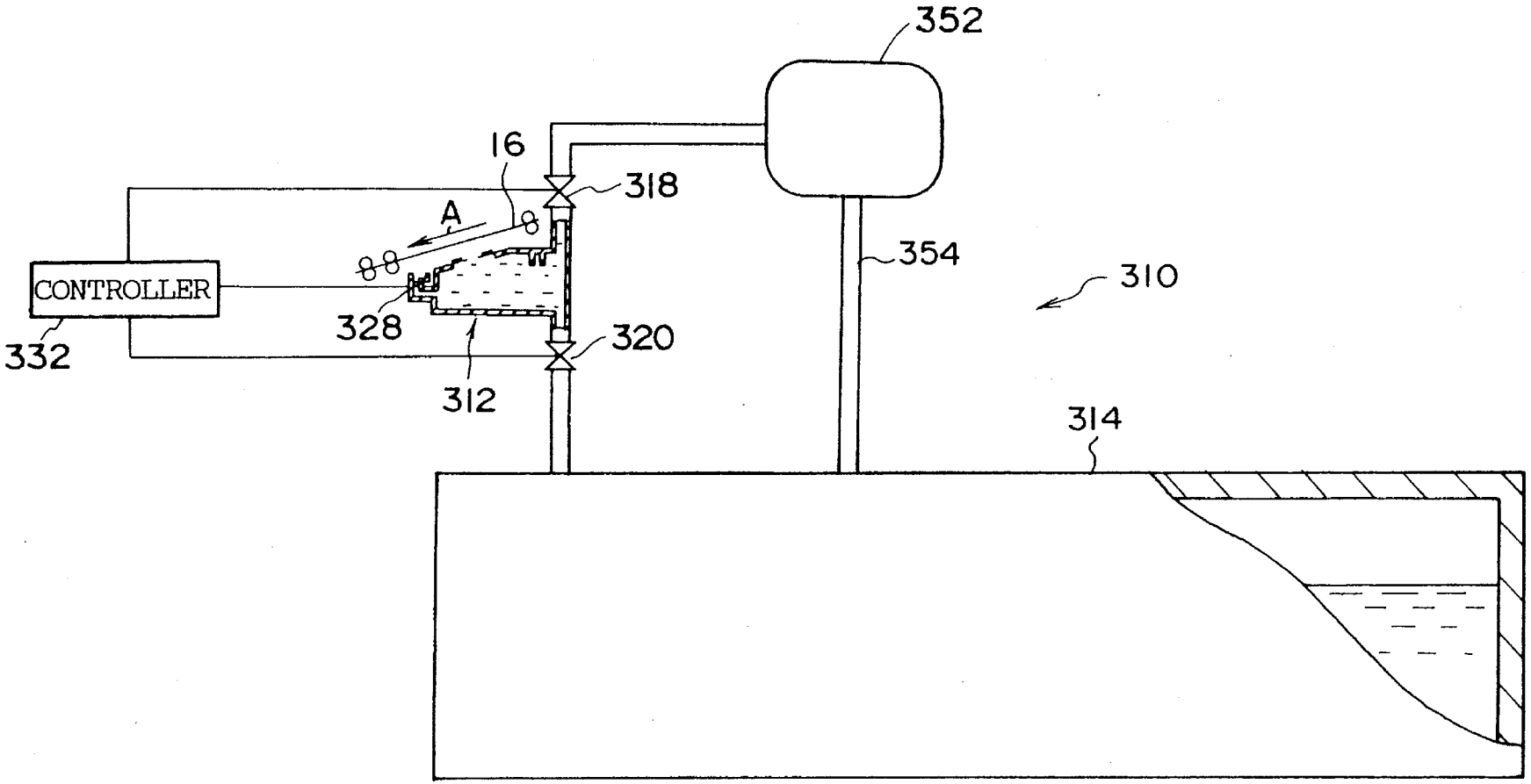
FIG. 13 is a schematic structural view of an overall structure of an applying device of an image recording apparatus relating to a third embodiment of the present invention.

The applying device 310 of the image recording apparatus 10 relating to a third embodiment of the present invention is illustrated in FIG. 13 and is described hereinafter. Members which are the same as those described in the first embodiment are denoted by the same reference numerals, and duplicate description thereof is omitted.

As illustrated in FIG. 13, the pool tank 314 in which water is accumulated is disposed beneath the spray tank 312 relating to the present embodiment. A pipe 354 is connected in a loop-shape to the upper side of the pool tank 314. The spray tank 312 is disposed on the route of the pipe 354.

A pump 352, which sends water out from the pool tank 314 to the spray tank 312, is disposed on the route of the pipe 354 between the upper valve 318 and the pool tank 314. Namely, the pump 352 is disposed between the spray tank 312 and the pool tank 314 and supplies water to the spray tank 312.

Next, operation of the present embodiment will be described.

The present embodiment has the same operation as that of the first embodiment. However, in the present embodiment, because the pump 352 forcibly sends water from the pool tank 314 to the spray tank 312, water is supplied even more reliably from the pool tank 314.

Further, because water can be forcibly supplied to the interior of the spray tank 312 by the pump 352, additional water can be supplied, and the interior of the spray tank 312 can be washed when the water is changed.

The applying device 310 of the image recording apparatus 10 relating to a fourth embodiment of the present invention is illustrated in FIGS. 14 through 19, and is described hereinafter. Members which are the same as those described in the first embodiment are denoted by the same reference numerals, and duplicate description thereof is omitted.

Figure 14:
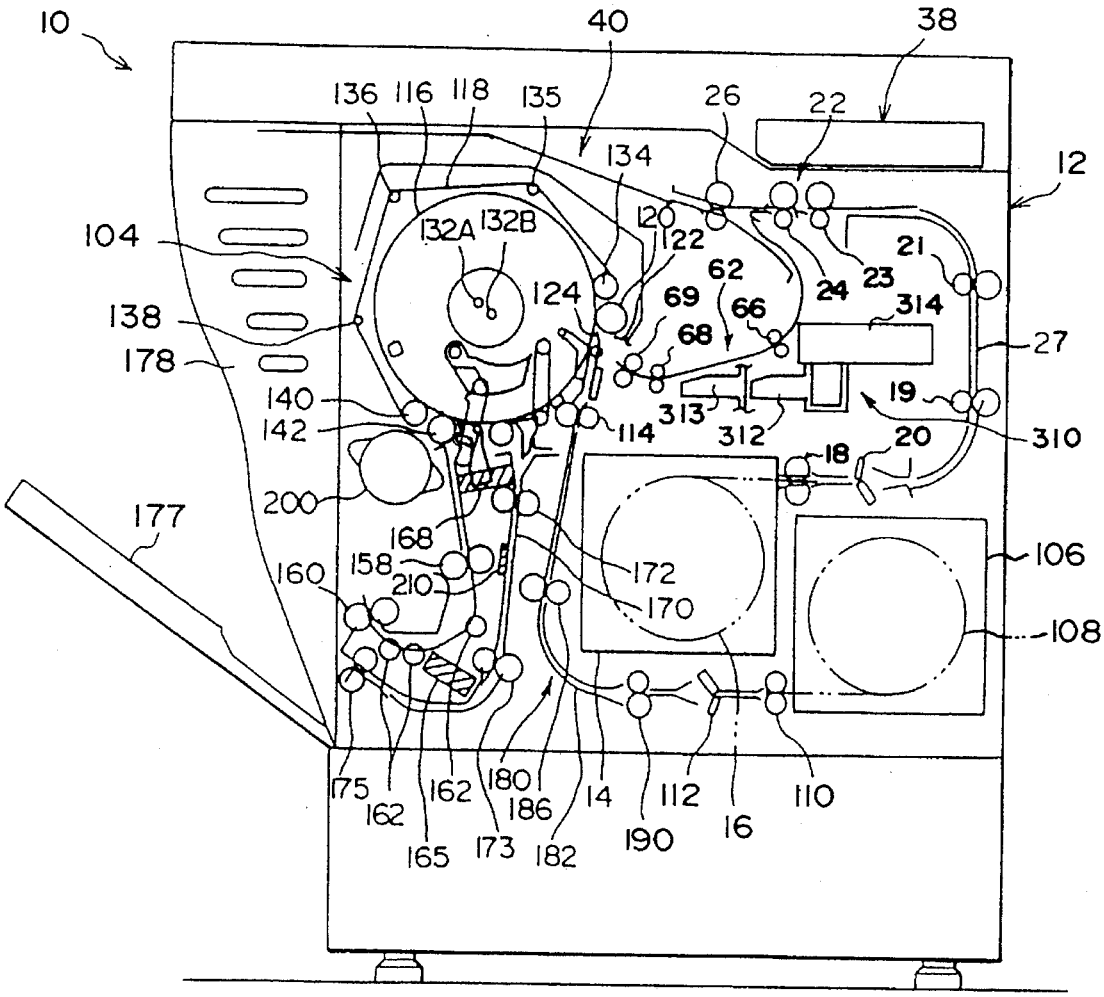
FIG. 14 is a schematic structural view of an overall structure of an image recording apparatus relating to a fourth embodiment of the present invention.

FIG. 14 is a schematic structural view of the entire structure of the image recording apparatus 10 which relates to the present embodiment and has substantially the same structure as the image recording apparatus 10 relating to the first embodiment.

Conveying paths and the like of the photosensitive material 16 which are the same as those of the first embodiment are formed within the machine stand 12 of the image recording apparatus 10 illustrated in FIG. 14.

Figure 15:
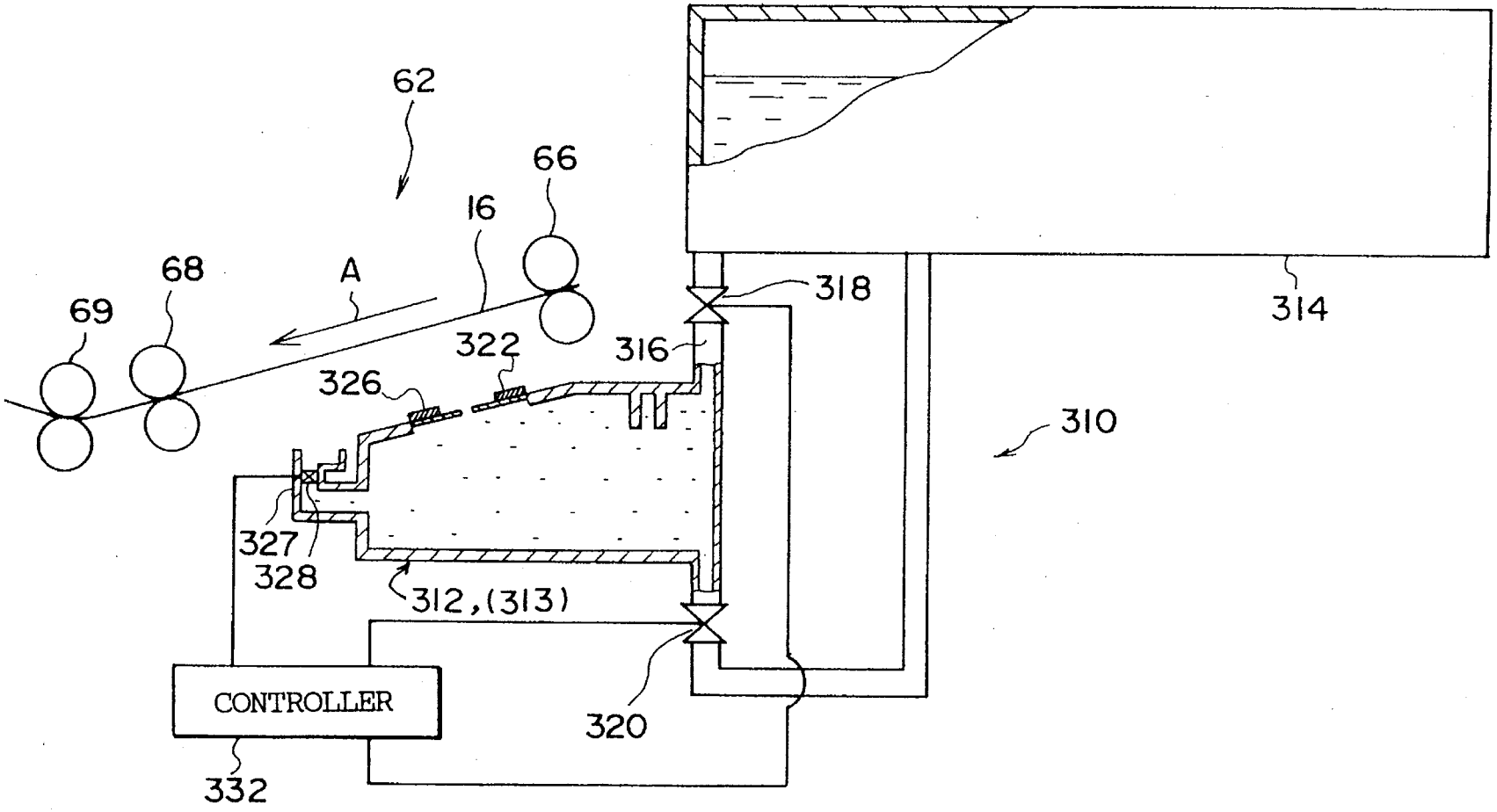
FIG. 15 is a schematic structural view of an overall structure of an applying device of the image recording apparatus relating to the fourth embodiment of the present invention.

As shown in FIGS. 14 and 15, the spray tank 312 which is a first head unit is disposed at a position opposing the conveying path A of the photosensitive material 16 in the water applying section 62. A spray tank 313 which is a second head unit is disposed at the downstream side of the conveying path A of the photosensitive material 16 with respect to the spray tank 312. The pair of conveying rollers 66 are disposed at the photosensitive material 16 conveying direction upstream side of the spray tank 312, and the two pairs of conveying rollers 68, 69 are disposed at the photosensitive material 16 conveying path downstream side of the spray tank 313.

Further, the pool tank 314, in which water serving as a solvent for forming an image is accumulated, is disposed above the spray tank 312. The pipe 316 is connected in a loop-shape to the bottom side of the pool tank 314. The spray tank 312 is disposed on the route of the pipe 316. The pool tank 314 is connected to the spray tank 313 as well in the same manner via pipes, valves, and the like. As the spray tank 313 has the same internal structure as the spray tank 312, duplicate description thereof is omitted.

Figure 16:
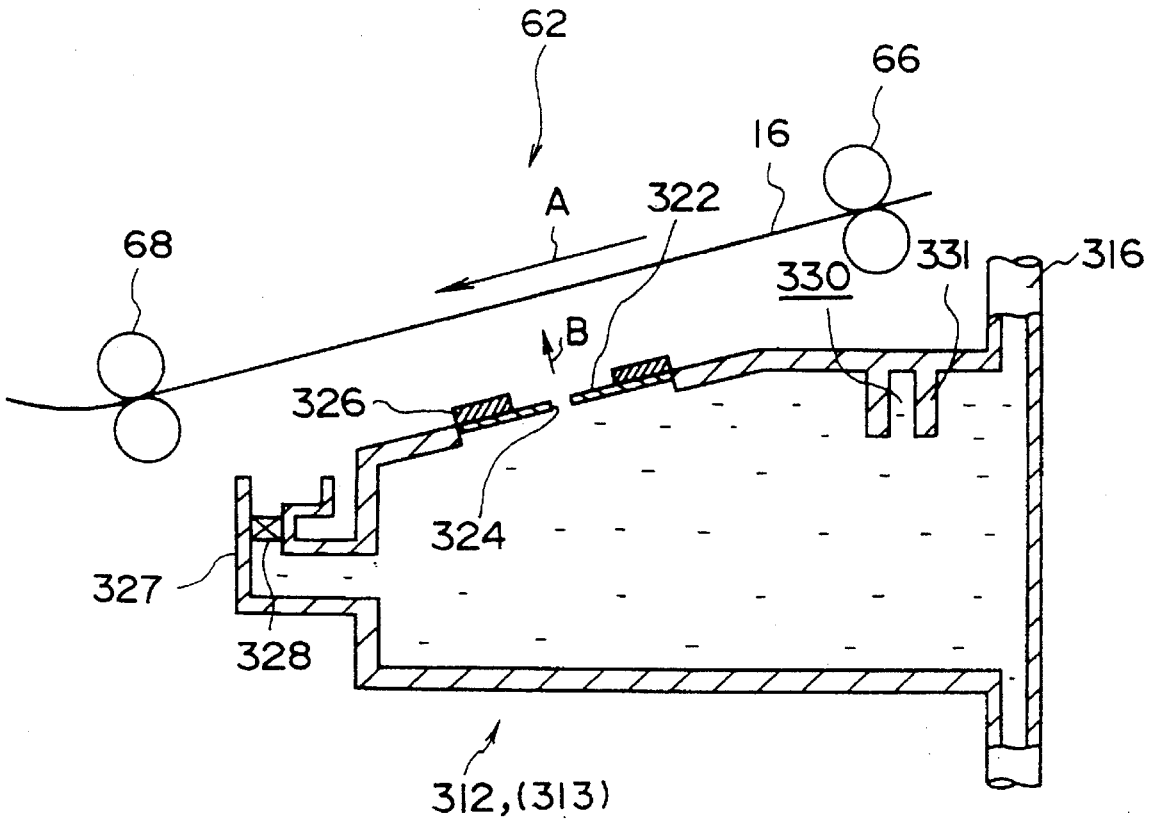
FIG. 16 is an enlarged partially sectional view of a spray tank relating to the fourth embodiment of the present invention.

As illustrated in FIG. 16 which is an enlarged view of the spray tank 312, the head plate 322 is disposed at a portion of the wall surface of the spray tank 312 which wall surface opposes the conveying path A of the photosensitive material 16. The head plate 322 is formed by an elastically deformable thin plate.

Figure 17:
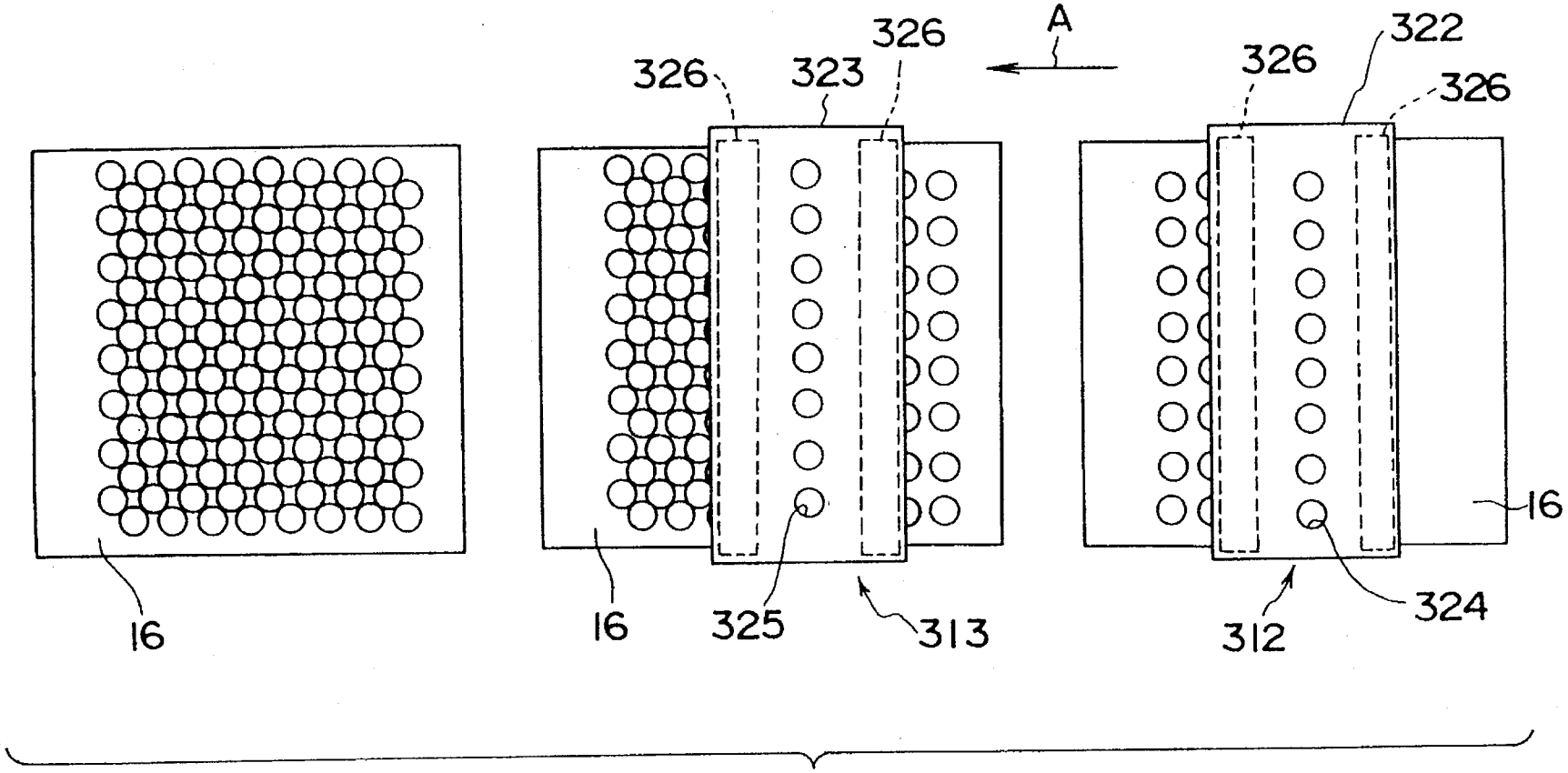
FIG. 17 is an explanatory view explaining an arrangement of nozzle holes of a spray tank relating to the fourth embodiment of the present invention.

As illustrated in FIG. 17, the plurality of nozzle holes 324 (respectively having a diameter of, for example, several tens of μm) for spraying the water filled in the spray tank 312 are arranged at the head plate 322 so as to be aligned linearly at fixed intervals along a direction intersecting the conveying direction A of the photosensitive material 16. Therefore, water within the spray tank 312 can be discharged from the respective nozzle holes 324 toward the photosensitive material 16.

As shown in FIG. 17, in the same way, a plurality of nozzle holes 325 (respectively having a diameter of, for example, several tens of μm) are arranged at a head plate 323 of the spray tank 313 so as to be aligned linearly at fixed intervals along a direction intersecting the conveying direction of the photosensitive material 16. However, as shown in this figure, the nozzle holes 325 are arranged at the head plate 323 so as to be offset with respect to the nozzle holes 324 of the spray tank 312, so that water can be additionally sprayed between the water droplets sprayed by the nozzle holes 324 of the spray tank 312.

Monomorphic or bimorphic piezoelectric elements 326 which are actuators are adhered on the head plates 322, 323. An unillustrated power source is connected to the piezoelectric elements 326.

Figure 18:
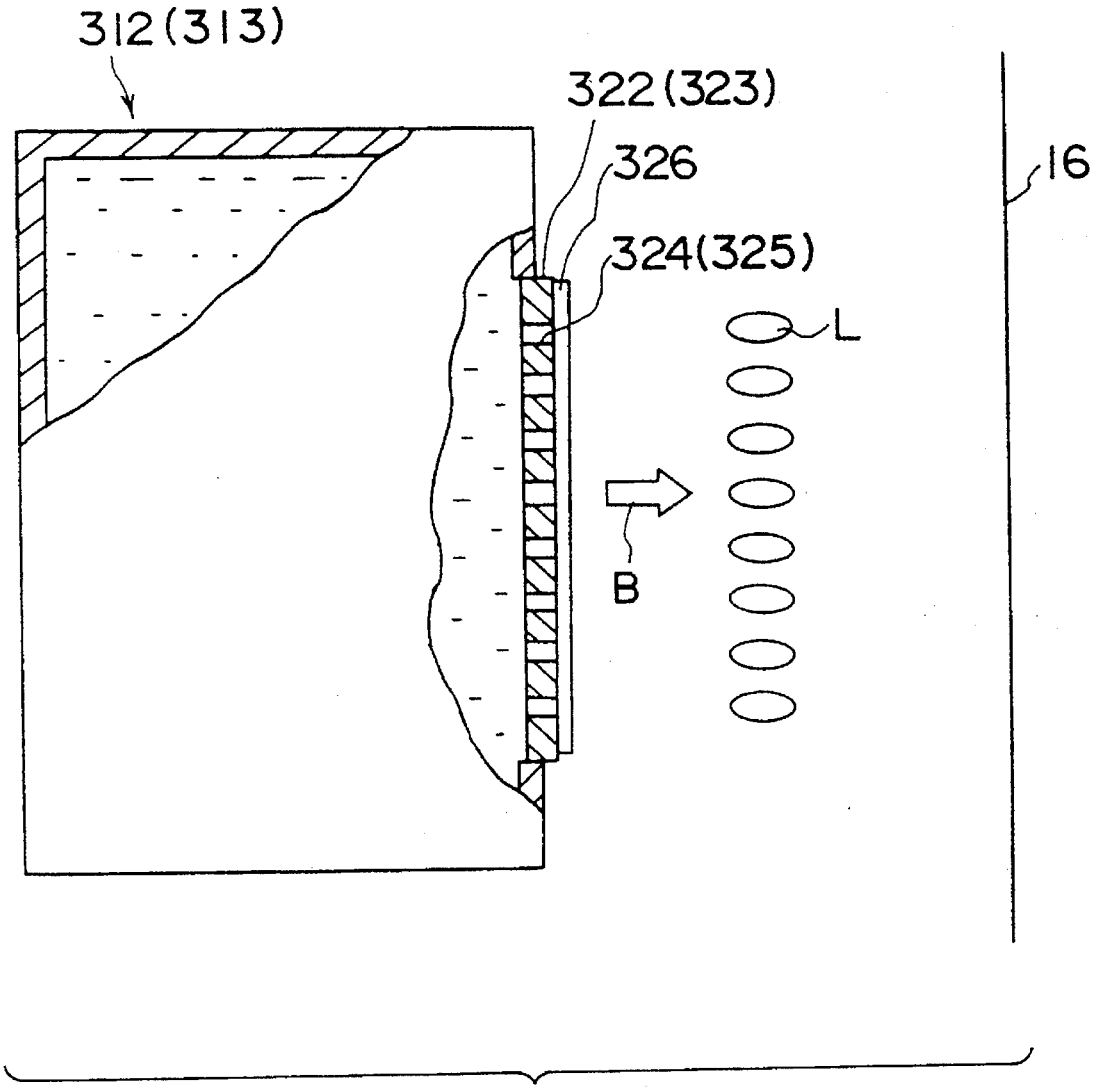
FIG. 18 is an explanatory view concisely illustrating the spray tank relating to the fourth embodiment of the present invention.

Accordingly, when electric power is supplied to the piezoelectric elements 326 from the power source, the piezoelectric elements 326 bend the head plates 322, 323 so that the respective central portions of the head plates 322, 323 are displaced toward the photosensitive material 16 on the conveying path A (i.e., so that the central portions are displaced along the direction of arrow B which is a direction normal to the head plates 322, 323). As the head plates 322, 323 are displaced toward the photosensitive material 16, water droplets L are expelled from the nozzle holes 324, 325 as shown in FIG. 18 which concisely illustrates the spray tanks 312, 313.

Next, operation of the present embodiment will be described.

Water is applied to the photosensitive material 16, which is being conveyed along the conveying path A in the same way as in the first embodiment, by spray from the spray tank 312 and the spray tank 313. The operations at this time will be described hereinafter.

First, water is supplied from the pool tank 314 to the spray tank 312 via the pipe 316 due to gravity. Water is filled in the spray tank 312, and is filled in the spray tank 313 as well in the same way.

Accordingly, in a state in which water has been filled, electric power from the power source is supplied to the piezoelectric elements 326 so that the piezoelectric elements 326 deform, and the head plate 322 of the spray tank 312 is displaced. As the head plate 322 is displaced, water is emitted in the direction of arrow B from the respective nozzle holes 324 and adheres on the photosensitive material 16 which is being conveyed. At this time, as illustrated in FIG. 17, the plurality of nozzle holes 324 spraying water are arranged at the spray tank 312 so as to be aligned linearly at fixed intervals along a direction intersecting the conveying direction A of the photosensitive material 16. Therefore, water is applied to the entire surface of the photosensitive material 16 by the continuous spraying of water from the nozzle holes 324.

The plurality of nozzle holes 325, which spray water between the water droplets sprayed by the nozzle holes 324 of the spray tank 312, are arranged at the spray tank 313 so as to be aligned linearly at fixed intervals along a direction intersecting the conveying direction A of the photosensitive material 16. Namely, water is sprayed between the water droplets, which were sprayed by the nozzle holes 324 of the spray tank 312, by the plurality of nozzle holes 325 of the spray tank 313. The timing of the spraying of the nozzle holes 325 of the spray tank 313 is controlled by the controller 332 in synchronization with the conveying speed of the photosensitive material 16.

Accordingly, water can be applied to a wide range on the photosensitive material 16 by the head plate 322 of the spray tank 312 being displaced one time due to the piezoelectric elements 326. Similarly, by the head plate 323 of the spray tank 313 being displaced one time, water can be applied to portions of the photosensitive material 16 to which water has not yet been applied.

After a fixed period of time has passed from the time when water is sprayed from the nozzle holes 324 of the spray tank 312, water droplets sprayed from the nozzle holes 325 of the spray tank 313, which is disposed at the photosensitive material 16 conveying path downstream side of the spray tank 312, are applied between the water droplets which were sprayed from the nozzle holes 324 of the spray tank 312.

Accordingly, even in cases in which the swelling characteristic is poor, the spaces between the plurality of water droplets sprayed from the nozzle holes 324 of the spray tank 312 can be made large. As a result, adjacent water droplets on the photosensitive material 16 which were sprayed from the nozzle holes 324 of the spray tank 312 do not contact each other and do not coalesce.

After the plurality of water droplets sprayed from the nozzle holes 324 of the spray tank 312 have penetrated into the photosensitive material 16, between these water droplets, water droplets sprayed from the nozzle holes 325 of the spray tank 313 are applied. Therefore, water droplets from the spray tank 312 and adjacent water droplets from the spray tank 313 do not coalesce, and water is not applied unevenly.

Figure 19A:
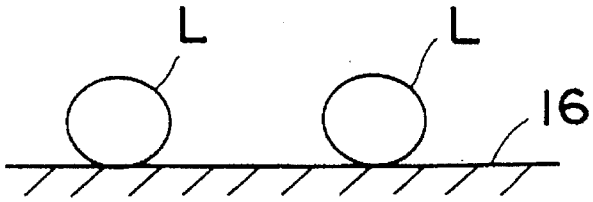
Figure 19B:
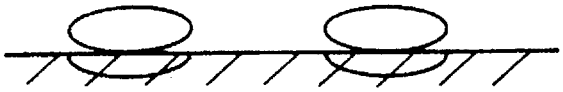
Figure 19C:
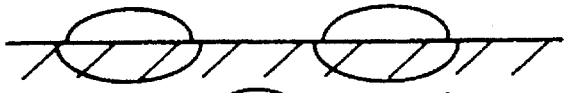
Figure 19D:
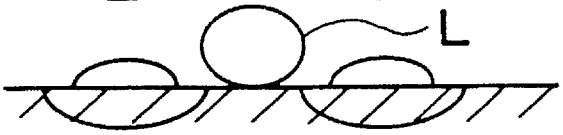
Figure 19E:
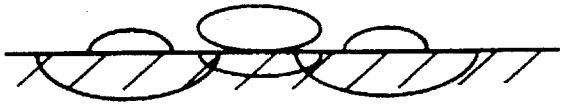
Figure 19F:
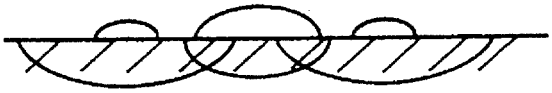
Figure 19G:
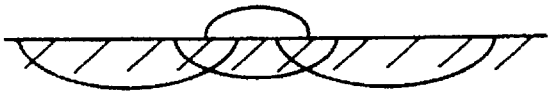

Namely, as illustrated in FIGS. 19A–19G, a plurality of water droplets sprayed from the nozzle holes 324 of the spray tank 312 are applied to the photosensitive material 16, and the water droplets L penetrate in the order illustrated in FIGS. 19A, 19B and 19C. Thereafter, as illustrated in FIG. 19D, the water droplets L sprayed from the nozzle holes 325 of the spray tank 313 are applied to the gap portions of the photosensitive material 16 (i.e., between the water droplets L sprayed by the nozzle holes 324 of the spray tank 312). Then, these water droplets L from the nozzle holes 325 penetrate in the order illustrated in FIGS. 19E, 19F and 19G. At this time, because the water droplets L on the photosensitive material 16 do not contact other water droplets L, the water droplets do not coalesce, and water is not applied unevenly.

Because the particle size is determined by the nozzle holes 324, 325 and because gas does not mix with the liquid, there is no dispersion in the particle size. Further, because the nozzle holes 324, 325 are aligned linearly at fixed intervals, there is no dispersion in the landing positions of the water droplets.

The plurality of nozzle holes 324, 325 are arranged at the spray tanks 312, 313 so as to be aligned linearly at fixed intervals along a direction which intersects the conveying direction of the photosensitive material 16. Therefore, there is no need to scan the head plates 322, 323 on a two-dimensional plane, and water can be applied to a large area in a short time.

Figure 20:
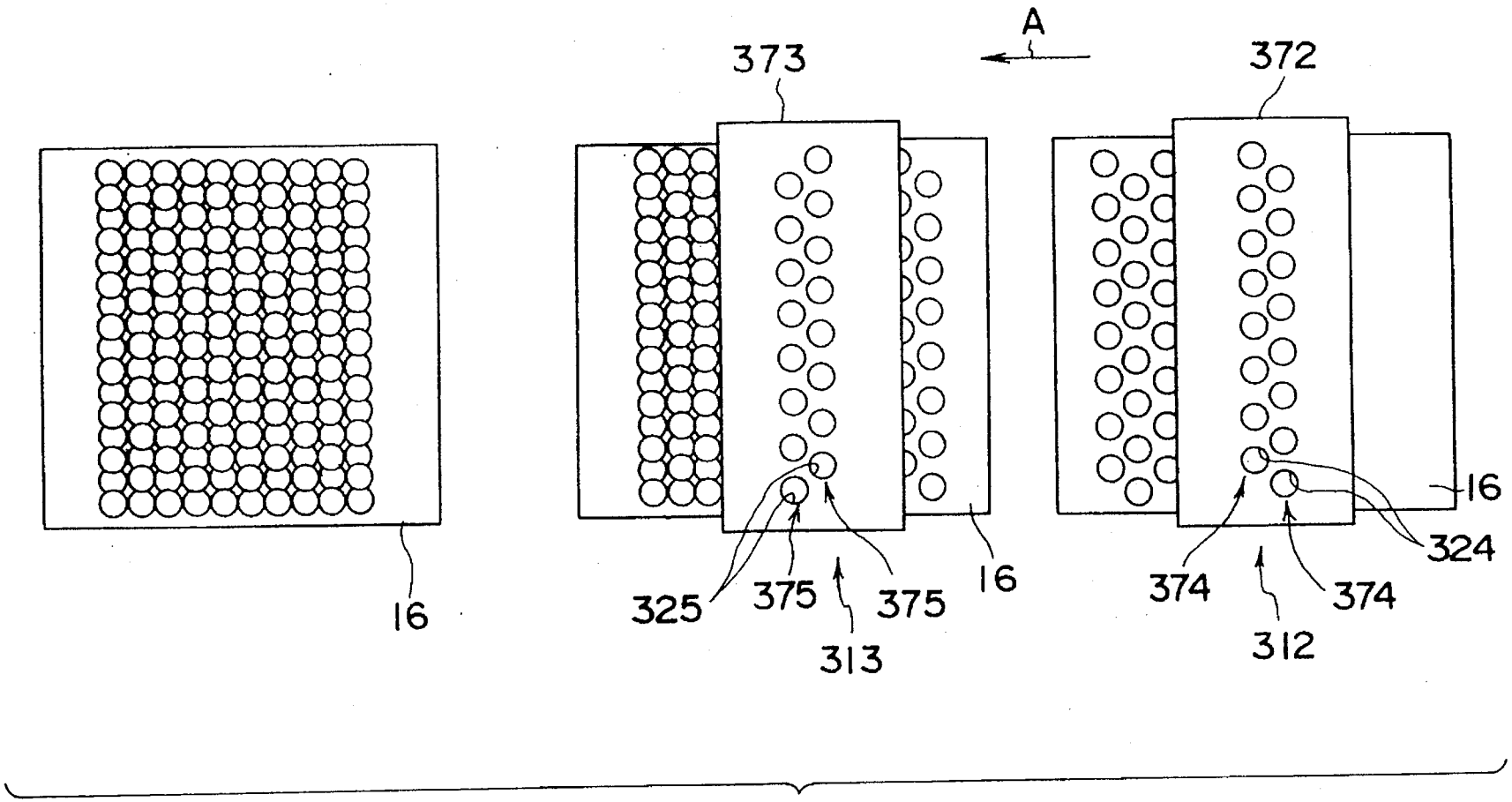
FIG. 20 is an explanatory view explaining arrangements of nozzle holes of spray tanks relating to a fifth embodiment of the present invention.
Figure 21A:
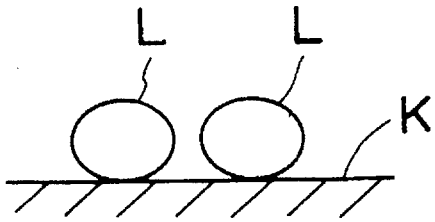
Figure 21B:
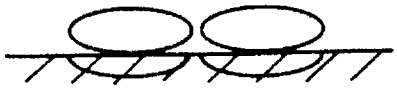
Figure 21C:
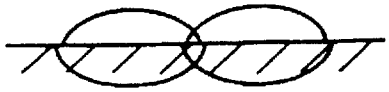
Figure 21D:
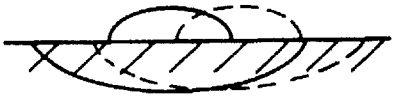
Figure 21E:
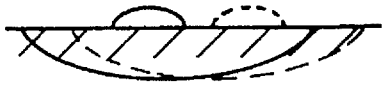
Figure 21F:
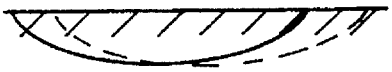

The head plate of the image recording apparatus 10 relating to a fifth embodiment of the present invention is illustrated in FIG. 20 and is described hereinafter. Members which are the same as those described in the first and fourth embodiments are denoted by the same reference numerals, and duplicate description thereof is omitted.

As illustrated in FIG. 20, in the head plate 372 of the spray tank 312 which is the first unit, two rows of nozzle rows 374 are arranged so as to be staggered. In each nozzle row 374, the plurality of nozzle holes 324 which spray water are aligned linearly at fixed intervals along a direction intersecting the direction of the conveying path A of the photosensitive material 16.

The spray tank 313 which is a second head unit is disposed at the downstream side of the conveying path A of the photosensitive material 16 with respect to the spray tank 312. In the same way as the head plate 372, in a head plate 373 of the spray tank 313, two rows of nozzle rows 375 are arranged so as to be staggered. In each nozzle row 375, the plurality of nozzle holes 325 are aligned linearly at fixed intervals along a direction intersecting the conveying direction of the photosensitive material 16. However, the nozzle holes 325 of the nozzle rows 375 are arranged so as to be offset with respect to the nozzle holes 324, so that water can be additionally sprayed between the water droplets sprayed by the nozzle holes 324 of the spray tank 312.

Operation of the present embodiment will now be described.

The operation of the present embodiment is the same as the operation of the first embodiment and the fourth embodiment. However, the present embodiment is structured such that the nozzle row 374, in which the plurality of nozzle holes 324 are aligned linearly at fixed intervals along a direction intersecting the conveying direction of the photosensitive material 16, and the nozzle row 375, in which the plurality of nozzle holes 325 are similarly aligned linearly, are arranged in a plurality of staggered rows at the head plates 372, 373 respectively. As a result, a large number of water droplets adhere to the photosensitive material 16 by a small number of sprays. Close-packing of water is made possible. The amount of water applied can be increased, and uniformity can be improved.

Although two head units are provided in the above-described embodiments, three or more head units may be provided. Further, three or more nozzle rows may be formed. Moreover, the above embodiments are structured such that the photosensitive material is moved by being conveyed. However, the embodiments may be structured such that the photosensitive material is stopped and the head units are moved.

In the first through the fifth embodiments, the photosensitive material 16 and the image receiving material 108 are used as the image recording materials. After exposure, the photosensitive material 16 is conveyed so as to be positioned at the outer side of the image receiving material 108. However, the present invention is not limited to the same, and cases in which the photosensitive material 16 is conveyed so as to be positioned at the inner side are also applicable. Further, the present invention is not limited to these materials, and is also applicable to other sheet-like or roll-shaped image recording materials.

The device for applying a solvent for forming an image relating to the present invention and having the above-described structure has superior effects such as improving the uniformity of the liquid on the application surface. Further, the device has excellent effects in that the stability of the liquid spray pressure conditions and the stability of the supply of the liquid can be ensured, and in that the solvent for forming an image can be sprayed stably over a long period of time. The device also has the outstanding effect of preventing coalescence of the liquid on the application surface so that uneven application can be mitigated.

What is claimed is:

1. A device for applying a solvent for forming an image, comprising:

a spray tank which is disposed to oppose a conveying path of an image recording material which has been image-exposed, said spray tank containing a solvent for forming an image;

a nozzle formed on said spray tank as a portion of a wall surface of said spray tank which wall surface opposes the conveying path of the image recording material, a plurality of nozzle holes which spray the solvent for forming an image being arranged in said nozzle to be aligned linearly at fixed intervals along a direction intersecting a conveying direction of the image recording material; and an actuator which displaces said nozzle, one time, toward the image recording material on the conveying path, so a to emit droplets of the solvent from the respective nozzle holes so that the solvent adheres to said image recording material which is being conveyed and thereby is applied to a wide range of the image recording material.

2. A device for applying a solvent for forming an image according to claim 1, wherein said nozzle comprises an elastically deformable thin plate.

3. A device for applying a solvent for forming an image according to claim 1, wherein said nozzle comprises a plate having high rigidity.

4. A device for applying a solvent for forming an image according to claim 1, wherein said actuator comprises piezoelectric elements.

5. A device for applying a solvent for forming an image according to claim 1, wherein said actuator comprises electromagnets.

6. A device for applying a solvent for forming an image, comprising:

a spray tank which is disposed to oppose a conveying path of an image recording material which has been image-exposed, said spray tank containing a solvent for forming an image;

a nozzle formed on said spray tank as a portion of a wall surface of said spray tank which wall surface opposes the conveying path of the image recording material, a plurality of nozzle rows being arranged in said nozzle to be staggered, each of the plurality of nozzle rows comprising a plurality of nozzle holes which spray the solvent for forming an image and which are aligned linearly at fixed intervals along a direction intersecting a conveying direction of the image recording material; and an actuator which displaces said nozzle, one time, toward the image recording material on the conveying path, so as to emit droplets of the solvent from the respective nozzle holes so that the solvent adheres to said image recording material which is being conveyed end thereby is applied to a wide range of the image recording material.

7. A device for applying a solvent for forming an image according to claim 6, wherein said nozzle comprises an elastically deformable thin plate.

8. A device for applying a solvent for forming an image according to claim 6, wherein said actuator comprises piezoelectric elements.

9. A device for applying a solvent for forming an image, comprising:

a head portion disposed to oppose a conveying path of an image recording material which has been image-exposed, said head portion having nozzle holes which spray a solvent for forming an image;

a spray tank, said head portion being mounted on said spray tank, and an opening portion is formed in said spray tank, said spray tank being adapted to contain the solvent for forming an image;

a replenishing tank disposed above said spray tank, and in which the solvent for forming an image is accumulated, said replenishing tank being connected to said spray tank and supplying the solvent for forming an image to said spray tank by gravity;

a first valve which opens a flow path between said spray tank and said replenishing tank when the solvent for forming an image is supplied to said spray tank; and a second valve which opens the opening portion and communicates an interior and an exterior of said spray tank when the solvent for forming an image is sprayed from said head portion.

10. A device for applying a solvent for forming an image according to claim 9, wherein the nozzle holes of said head portion are arranged so as to be aligned linearly at fixed intervals along a direction intersecting a conveying direction of the image recording material.

11. A device for applying a solvent for forming an image according to claim 9, wherein said head portion comprises an actuator which displaces, toward the image recording material on the conveying path, a portion of said head which portion has said nozzle holes.

12. A device for applying a solvent for forming an image according to claim 9, wherein said replenishing tank is connected to said spray tank via a looped shaped pipe, and said spray tank being disposed on the route of said pipe.

13. A device for applying a solvent for forming an image according to claim 9, wherein a first valve is provided above said spray tank.

14. A device for applying a solvent for forming an image, comprising:

a head portion disposed to oppose a conveying path of an image recording material which has been image-exposed, said head portion having nozzle holes which spray a solvent for forming an image;

a spray tank to which said head portion is mounted, said spray tank having an opening portion, said spray tank being adapted to contain the solvent for forming an image;

a replenishing tank in which the solvent for forming an image is accumulated, said replenishing tank being connected to said spray tank;

a pump disposed between said spray tank and said replenishing tank, and delivering the solvent for forming an image from said replenishing tank to said spray tank;

a first valve which opens a flow path between said spray tank and said replenishing tank when the solvent for forming an image is supplied to said spray tank; and a second valve which opens the opening portion and communicates an interior and an exterior of said spray tank when the solvent for forming an image is sprayed from said head portion.

15. A device for applying a solvent for forming an image according to claim 14, wherein said replenishing tank is disposed lower than said spray tank, and said pump delivers the solution for forming an image from said replenishing tank to said spray tank.

16. A device for applying a solvent for forming an image, comprising:

a first head unit which is disposed to oppose a conveying path of an image recording material which has been image-exposed, a plurality of nozzle holes which spray a solvent for forming an image being arranged in said first head unit to be aligned linearly at fixed intervals along a direction intersecting a conveying direction of the image recording material; and a second head unit which is disposed at the downstream side of the conveying path of the image recording material with respect to said first head unit, a plurality of nozzle holes, which spray the solvent forming an image between liquid droplets which were sprayed by the nozzle holes of said first head unit, being arranged in said second head unit to be aligned linearly at fixed intervals along a direction intersecting the conveying direction of the image recording material.

17. A device for applying a solvent for forming an image according to claim 16, wherein said first head unit and said second head unit have head plates, and the nozzle holes are formed in the head plates, and said first head unit and said second head unit have actuators which displace the head plates, and the nozzle holes spray the solvent for forming an image due to displacement of the head plates by the actuators.

18. A device for applying a solvent for forming an image according to claim 17,,wherein the actuators comprises piezoelectric elements.

19. A device for applying a solvent for forming an image, comprising:

a first head unit which is disposed to oppose a conveying path of an image recording material which has been image-exposed, a plurality of nozzle rows being arranged in said first head unit to be staggered, each of the plurality of nozzle rows comprising a plurality of nozzle holes which spray a solvent for forming an image and which are aligned linearly at fixed intervals along a direction intersecting a conveying direction of the image recording material; and a second head unit which is disposed at the downstream side of the conveying path of the image recording material with respect to said first head unit, a plurality of nozzle rows being arranged in said second head unit to be staggered, each of the plurality of nozzle rows comprising a plurality of nozzle holes which spray the solvent for forming an image between liquid droplets sprayed by the nozzle holes of said first head unit and which are aligned linearly at fixed intervals along a direction intersecting the conveying direction of the image recording material.

20. A device for applying a solvent for forming an image according to claim 19, wherein said first head unit and said second head unit have head plates, and the nozzle holes are formed in the head plates, and said first head unit and said second head unit have actuators which displace the head plates, and the nozzle holes spray the solvent for forming an image due to displacement of the head plates by the actuators.

* * * * *